US009728853B2

(12) United States Patent
Hung

(10) Patent No.: US 9,728,853 B2
(45) Date of Patent: Aug. 8, 2017

(54) ANTENNA STRUCTURE

(71) Applicant: MEDIATEK Inc., Hsin-Chu (TW)

(72) Inventor: Chung-Yu Hung, Taipei (TW)

(73) Assignee: MEDIATEK INC., Hsin-Chu (TW)

( * ) Notice: Subject to any disclaimer, the term of this patent is extended or adjusted under 35 U.S.C. 154(b) by 64 days.

(21) Appl. No.: 14/705,151

(22) Filed: May 6, 2015

(65) Prior Publication Data

US 2016/0104935 A1 Apr. 14, 2016

Related U.S. Application Data

(60) Provisional application No. 62/063,499, filed on Oct. 14, 2014.

(51) Int. Cl.
*H01Q 5/371* (2015.01)
*H01Q 1/48* (2006.01)
(Continued)

(52) U.S. Cl.
CPC ..... *H01Q 5/371* (2015.01); *H01Q 1/243* (2013.01); *H01Q 1/48* (2013.01); *H01Q 7/00* (2013.01);
(Continued)

(58) Field of Classification Search
CPC ..... H01Q 13/10; H01Q 1/243; H01Q 1/48; H01Q 21/30; H01Q 5/371; H01Q 7/00; H01Q 9/0421; H01Q 9/42
(Continued)

(56) References Cited

U.S. PATENT DOCUMENTS 6,157,344 A * 12/2000 Bateman ..... G06F 1/1616 343/700 MS
6,342,856 B1 * 1/2002 Nakano ..... H01Q 7/00 343/700 MS
(Continued)

FOREIGN PATENT DOCUMENTS

EP 2528165 11/2012
EP 2704255 A1 3/2014
(Continued)

OTHER PUBLICATIONS

EP Search Report dated Feb. 5, 2016 in corresponding application (No. 15172390.5-1811).
(Continued)

*Primary Examiner* — Tho G Phan
(74) *Attorney, Agent, or Firm* — McClure, Qualey & Rodack, LLP

(57) ABSTRACT

The present disclosure provides an antenna structure, including a feed terminal, an intermediate grounding terminal, a tail grounding terminal, a conductive head section and a conductive intermediate section. The feed terminal is for connecting a feed signal. The intermediate grounding terminal is responsible for conducting to a ground plane via an intermediate impedance during a second operation mode, and ceasing conducting via the intermediate impedance during a first operation mode. The tail grounding terminal is for connecting the ground plane. The head section extends from the feed terminal to the intermediate grounding terminal along a loop. The intermediate section extends from the intermediate grounding terminal to the tail grounding terminal along the loop.

21 Claims, 35 Drawing Sheets

(51) Int. Cl.

| | |
|---|---|
| ***H01Q 7/00*** | (2006.01) |
| ***H01Q 1/24*** | (2006.01) |
| ***H01Q 9/04*** | (2006.01) |
| ***H01Q 9/42*** | (2006.01) |
| ***H01Q 13/10*** | (2006.01) |
| ***H01Q 21/30*** | (2006.01) |

(52) U.S. Cl.
CPC ..... *H01Q 9/0421* (2013.01); *H01Q 9/42* (2013.01); *H01Q 13/10* (2013.01); *H01Q 21/30* (2013.01)

(58) Field of Classification Search
USPC ..... 343/700 MS, 702, 741, 742, 845, 846
See application file for complete search history.

(56) References Cited

U.S. PATENT DOCUMENTS

| | | | | |
|---|---|---|---|---|
| 7,079,079 | B2 * | 7/2006 | Jo | H01Q 1/243 343/700 MS |
| 7,193,565 | B2 * | 3/2007 | Caimi | H01Q 1/243 343/700 MS |
| 8,514,132 | B2 * | 8/2013 | Rao | H01Q 1/243 343/700 MS |
| 9,024,823 | B2 | 5/2015 | Bevelacqua | |
| 9,142,879 | B2 | 9/2015 | Galeev | |
| 9,203,140 | B2 | 12/2015 | Yong et al. | |
| 9,455,501 | B2 * | 9/2016 | Ziv | H01Q 21/28 |
| 2006/0097918 | A1 | 5/2006 | Oshiyama et al. | |
| 2014/0062801 | A1 | 3/2014 | Yong et al. | |
| 2014/0087674 | A1 | 3/2014 | Teng et al. | |
| 2014/0274231 | A1 | 9/2014 | De Luis et al. | |
| 2015/0048979 | A1 | 2/2015 | Asrani et al. | |
| 2015/0084817 | A1 | 3/2015 | Yong | |

FOREIGN PATENT DOCUMENTS

| | | | |
|---|---|---|---|
| EP | 2731194 | A1 | 5/2014 |
| EP | 2858172 | A1 | 4/2015 |
| WO | 2015125383 | | 8/2015 |

OTHER PUBLICATIONS

EP Office Action dated May 17, 2017 in European application (No. 15172390.5-1927).

* cited by examiner

ANTENNA STRUCTURE

This application claims the benefit of U.S. provisional application Ser. No. 62/063,499, filed Oct. 14, 2014, the subject matter of which is incorporated herein by reference.

FIELD OF THE DISCLOSURE

The present disclosure relates to an antenna structure, and more particularly, to an antenna structure facilitating better integration of antenna design and product design.

BACKGROUND OF THE DISCLOSURE

Modern electronic product, such as notebook computer, hand-held computer, tablet computer, mobile phone, smart phone, wearable gadget (e.g., wrest watch or glasses), digital camera, digital camcorder, navigator, or game console, etc., demands wireless functionality compliant to one or more wireless standards, and therefore needs antenna operable at compliant RF band(s) with compliant performances and/or characteristics to properly receive and/or transmit wireless signals. For example, a product demanding telecommunication functionality of LTE standard requires antenna operable at two RF bands respectively covering 700 MHz and 1800/1900 MHz. However, it is difficult to satisfy both product design (industry and/or mechanical design) and antenna design.

Antenna design aims to ensure compliance of antenna performances and/or characteristics, such as band location, bandwidth, return loss, efficiency, and/or impedance, etc. On the other hand, product design aims to enhance user experience. For example, a popular and prevailing design trend of wearable product like smart watch is to adopt metallic case (housing), and also demands compact size (smaller than smart phone) for user's comfort of wearing. While dimensions of antenna depend on wavelengths of compliant RF band(s), maintaining compact size constrains vacancy left for embedding antenna in the case. Furthermore, enclosing antenna inside metallic case seriously degrades antenna performances. Although cutting slot(s) on metallic case may ease antenna design, but is not preferred for compact-sized product like smart watch, because the slot(s) will look unpleasantly conspicuous on compact-sized product, and therefore become eyesore to impact product appearance.

Some smart watch designs implement antenna on watchband instead of the main case where watch panel locates, but suffer degraded antenna performances since the antenna is therefore closer to user skin, which is potentially conductive. Also, placing antenna on watchband is disadvantageous for user customization and personalization which rely on swapping watchbands.

SUMMARY OF THE DISCLOSURE

To address aforementioned issues, the disclosure provides an antenna structure which may be implemented by frame (periphery) of metallic case while maintaining intactness of the case without needs for slots, so as to satisfy both antenna design and product design.

An objective of the disclosure is providing an antenna structure (e.g., 100, 1000, 1400, 1800 or 2200 in FIG. 1, 10, 14, 18 or 22) which may include a feed terminal (e.g., d1, d2, d3, d4 or d5 in FIG. 2, 11, 15, 19 or 23), an intermediate grounding terminal (e.g., hg1, hg2, hg31, hg4 or hg5 in FIG. 2, 11, 15, 19 or 23), a tail grounding terminal (e.g., g1, g2, g3, g4 or g5 in FIG. 2, 11, 15, 19 or 23), a head section (e.g., sa1, sa2, sa3, sa4 or sa5 in FIG. 2, 11, 15, 19 or 23) and an intermediate section (e.g., sb1, sb2, sb3, sb4 or sb5 in FIG. 2, 11, 15, 19 or 23), with the feed terminal for connecting a feed signal (e.g., Sf1, Sf2, Sf3, Sf4 or Sf5 in FIG. 2, 11, 15, 19 or 23), the intermediate grounding terminal for conducting to a ground plane (e.g., G1, G2, G3, G4 or G5 in FIG. 2, 11, 15, 19 or 23) via an intermediate impedance (e.g., z1, z2, z31, z4 or z5 in FIGS. 5*b* to 5*c*, 12*b* to 12*c*, 16*b*, 20*b* to 20*c*, 24*b* to 24*c* or 25*b* to 25*c*) during a second operation mode (e.g., a high-band mode shown in FIGS. 5*b* to 5*c*, 12*b* to 12*c*, 16*b*, 20*b* to 20*c*, 24*b* to 24*c* or 25*b* to 25*c*), and ceasing conducting via the intermediate impedance during a first operation mode (e.g., a low-band mode shown in FIG. 5*a*, 12*a*, 16*a*, 20*a*, 24*a* or 25*a*); the tail grounding terminal for connecting the ground plane, the head section, being conductive, extending from the feed terminal to the intermediate grounding terminal along a loop (e.g., 102, 1002, 1402, 1802 or 2202 in FIG. 1, 10, 14, 18 or 22) surrounding the ground plane; the intermediate section, being conductive, extending from the intermediate grounding terminal to the tail grounding terminal along the loop. The loop may be a periphery of a metallic (conductive) case.

In an implementation, the antenna structure may further include a tail section (e.g., sc1, sc2 or sc3 in FIG. 2, 11 or 15) being conductive, and extending from the tail grounding terminal to the feed terminal along the loop, without overlapping the head section.

In an implementation, a length of the intermediate section may be longer than a sum of a length of the tail section and a length of the head section. In an implementation, a length of the intermediate section may be longer than a length of the head section, and longer than a length of the tail section. In an implementation, the tail grounding terminal may be responsible for connecting the ground plane via a tail impedance (e.g., zb1, zb2, zb3, zb4 or zb5 in FIG. 2, 11, 15, 19 or 23).

In an implementation, the antenna structure may be capable of providing a first band (e.g., LB1 in FIG. 4, 13, 17, 21 or 26) during the first operation mode, and providing a second band (e.g., HB1 in FIG. 4, 13, 17 21 or 26) during the second operation mode, wherein a frequency of the second band may be higher than a frequency of the first band.

In an implementation (e.g., FIG. 14, FIG. 15, FIG. 16*a* to FIG. 16*c* and FIG. 17), the antenna structure (e.g., 1400 in FIG. 15) may further a second intermediate grounding terminal (e.g., hg32 in FIG. 15) for conducting to the ground plane via a second intermediate impedance (e.g., z32 in FIG. 16*c*) during a third operation mode (e.g., FIG. 16*c*), and ceasing conducting via the second intermediate impedance during the first operation mode (e.g., FIG. 16*a*) and the second operation mode (e.g., FIG. 16*b*). The head section (e.g., sa3) may include a first front section (e.g., sa31 in FIG. 15) and a second front section (e.g., sa32 in FIG. 15), with the first front section extending from the feed terminal (e.g., d3 in FIG. 15) to the second intermediate grounding terminal (e.g., hg32 in FIG. 15) along the loop (e.g., 1402 in FIG. 15), and the second front section extending from the second intermediate grounding terminal to the intermediate grounding terminal (e.g., hg31 in FIG. 15) along the loop, without overlapping the first front section. Such antenna structure may be capable of providing a first band (e.g., LB1 in FIG. 17) during the first operation mode (e.g., FIG. 16*a*), providing a second band (e.g., HB1 in FIG. 17) during the second operation mode (e.g., FIG. 16*b*), and providing a third band and a fourth band (e.g., (e.g., B3 and B4 in FIG. 17) during the third operation mode (e.g., FIG. 16*c*), wherein a frequency of the second band may be higher than a frequency of the first band, a frequency of the third band may be between the frequency of the first band and the frequency of the second band, and, a frequency of the fourth band may be higher than the frequency of the second band.

In an implementation (e.g., FIGS. 22, 23, 24*a* to 24*c*, 25*a* to 25*c* and 26) which may implement multiple antennas (e.g., A1 and A2 in FIG. 23) in the same antenna structure (e.g., 2200 in FIG. 23), the antenna structure may further include an isolation grounding terminal (e.g., gi3 or gi4 in FIG. 23) and an isolation section (e.g., si3 or si4 in FIG. 23), with the isolation grounding terminal for connecting the ground plane (e.g., G5 in FIG. 23), and the isolation section, being conductive, extending from one of the feed terminal (e.g., d5 in FIG. 23) and the tail grounding terminal (e.g., g5 in FIG. 23) to the isolation grounding terminal (e.g., gi3 or gi4 in FIG. 23) along the loop, without overlapping the head section (e.g., sa5) and the intermediate section (e.g., sb5). While the feed terminal (e.g., d5 in FIG. 23) may connect the feed signal (e.g., Sf5 in FIG. 23) of a first antenna (e.g., A1 in FIG. 23), the antenna structure may further include a second feed terminal (e.g., d6 in FIG. 23) and an additional section (e.g., a loop portion extending from the terminals gi3, gi5 to d6 along the loop 2202 to be jointly formed by sections si7 and si5, or a loop portion extending from the terminals gi4, gi6, g6, hg6 to d6 along the loop 2202 to be jointly formed by sections si8, si6, sb6 and sa6), with the second feed terminal for connecting a second feed signal (e.g., Sf6 in FIG. 23) of a second antenna, and the additional section extending from the isolation terminal (e.g., gi3 or gi4) to the second feed terminal, without overlapping the isolation section. The second feed signal may be different from the feed signal.

An objective of the disclosure is providing an antenna structure (e.g., 100, 1000, 1400, 1800 or 2200 in FIG. 1, 10, 14, 18 or 22) which may include a feed terminal (e.g., d1, d2, d3, d4 or d5 in FIG. 2, 11, 15, 19 or 23), an intermediate grounding terminal (e.g., hg1, hg2, hg3, hg4 or hg5 in FIG. 2, 11, 15, 19 or 23), a tail grounding terminal (e.g., g1, g2, g3, g4 or g5 in FIG. 2, 11, 15, 19 or 23), a head section (e.g., sa1, sa2, sa3, sa4 or sa5 in FIG. 2, 11, 15, 19 or 23) and an intermediate section (e.g., sb1, sb2, sb3, sb4 or sb5 in FIG. 2, 11, 15, 19 or 23), with the feed terminal for connecting a feed signal (e.g., Sf1, Sf2, Sf3, Sf4 or Sf5 in FIG. 2, 11, 15, 19 or 23), the tail grounding terminal for connecting a ground plane (e.g., G1, G2, G3, G4 or G5 in FIG. 2, 11, 15, 19 or 23), the head section, being conductive, extending from the feed terminal to the intermediate grounding terminal along a loop (e.g., 102, 1002, 1402, 1802 or 2202 in FIG. 1, 10, 14, 18 or 22) surrounding the ground plane, capable of supporting a third electromagnetic resonance with two anti-nodes respectively at the feed terminal and the intermediate grounding terminal during a second operation mode (e.g., FIG. 5*c*, 12*c*, 16*b*, 20*c* or 24*c*); and, the intermediate section, being conductive, extending from the intermediate grounding terminal to the tail grounding terminal along the loop, capable of supporting a second electromagnetic resonance (e.g., FIG. 5*b*, 12*b*, 16*b*, 20*b* or 24*b*) with two anti-nodes respectively at the intermediate grounding terminal and the tail grounding terminal during the second operation mode (e.g., FIG. 5*b*, 12*b*, 16*b*, 20*b* or 24*b*). In addition, during a first operation mode (e.g., FIG. 5*a*, 12*a*, 16*a*, 20*a* or 24*a*), the head section and the intermediate section may further be capable of jointly supporting a first electromagnetic resonance with two anti-nodes respectively at the feed terminal and the tail grounding terminal, without anti-nodes located between the feed terminal and the tail grounding terminal on the head section and the tail section. The tail grounding terminal may be responsible for connecting the ground plane via a tail impedance.

In an implementation, the antenna structure may further include a tail section, being conductive, extending from the tail grounding terminal to the feed terminal along the loop, without overlapping the head section. A length of the intermediate section and a length of the tail section may be arranged to cause the second electromagnetic resonance to overpower electromagnetic resonance supported by the tail section.

In an implementation, the intermediate grounding terminal is responsible for conducting to the ground plane via an intermediate impedance (e.g., z1, z2, z31, z4 or z5 in FIGS. 5*b* to 5*c*, 12*b* to 12*c*, 16*b*, 20*b* to 20*c* or 24*b* to 24*c*) during the second operation mode, and ceasing conducting via the intermediate impedance during the first operation mode.

In an implementation, the antenna structure may be capable of providing a first band during the first operation mode, and providing a second band during the second operation mode, wherein a frequency of the second band may be higher than a frequency of the first band.

In an implementation (e.g., FIG. 14, FIG. 15 and FIG. 16*a* to FIG. 16*c*), the antenna structure (e.g., 1400) may further include a second intermediate grounding terminal (e.g., hg32), and the head section (e.g., sa3) may include a first front section (e.g., sa31) and a second front section (e.g., sa32), with the first front section extending from the feed terminal (e.g., d3) to the second intermediate grounding terminal along the loop (e.g., 1402), and the second front section extending from the second intermediate grounding terminal to the intermediate grounding terminal (e.g., hg31) along the loop, without overlapping the first front section. During a third operation mode (e.g., FIG. 16*c*), the first front section may be further capable of supporting a fourth electromagnetic resonance with two anti-nodes respectively at the feed terminal and the second intermediate grounding terminal, and the second front section and the intermediate section may further be capable of jointly supporting a fifth electromagnetic resonance with two anti-nodes respectively at the second intermediate grounding terminal and the tail grounding terminal. The second intermediate grounding terminal may be responsible for conducting to the ground plane via a second intermediate impedance (e.g., z32 in FIG. 16*c*) during the third operation mode, and ceasing conducting via the intermediate impedance during the first operation mode and the second operation mode. Such antenna structure may be capable of providing a first band during the first operation mode, providing a second band during the second operation mode, and providing a third band and a fourth band during the third operation mode, wherein a frequency of the second band may be higher than a frequency of the first band, a frequency of the third band may be between the frequency of the first band and the frequency of the second band, and a frequency of the fourth band may be higher than the frequency of the second band.

In an implementation which may implement multiple antennas in the same antenna structure, the antenna structure may further include an isolation grounding terminal and an isolation section, with the isolation grounding terminal for connecting the ground plane, and the isolation section, being conductive, extending from one of the feed terminal and the tail grounding terminal to the isolation grounding terminal along the loop, without overlapping the head section and the intermediate section. While the feed terminal may connect the feed signal of a first antenna, the antenna may further include a second feed terminal and an additional section, with the second feed terminal for connecting a second feed signal of a second antenna, and the additional section extending from the isolation terminal to the second feed terminal, without overlapping the isolation section. The second feed signal may be different from the feed signal.

Numerous objects, features and advantages of the present disclosure will be readily apparent upon a reading of the following detailed description of implementations of the present disclosure when taken in conjunction with the accompanying drawings. However, the drawings employed herein are for the purpose of descriptions and should not be regarded as limiting.

BRIEF DESCRIPTION OF THE DRAWINGS

The above objects and advantages of the present disclosure will become more readily apparent to those ordinarily skilled in the art after reviewing the following detailed description and accompanying drawings, in which.

DETAILED DESCRIPTION

Figure 1:
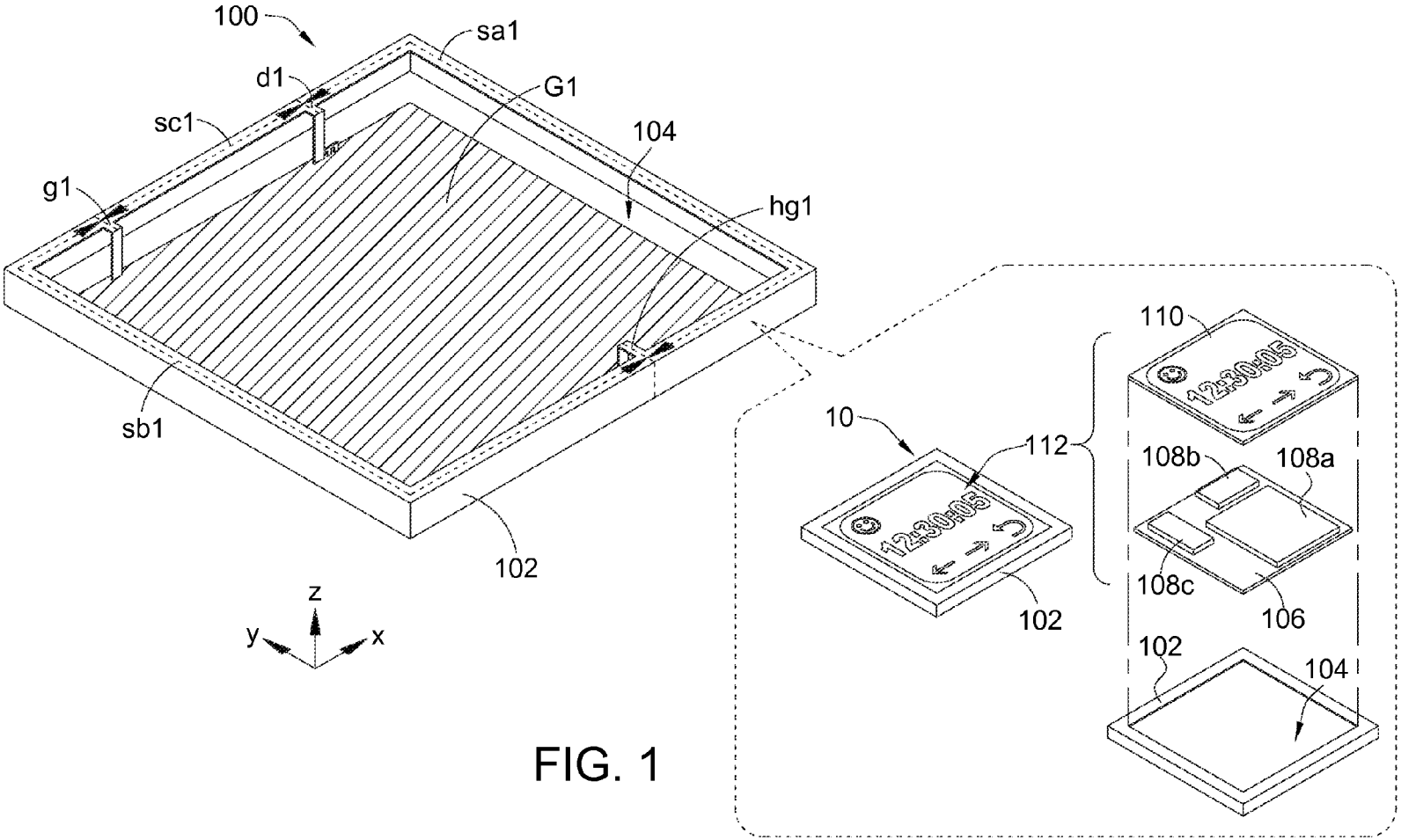
FIG. 1 illustrates an antenna structure according to an implementation of the disclosure.
Figure 2:
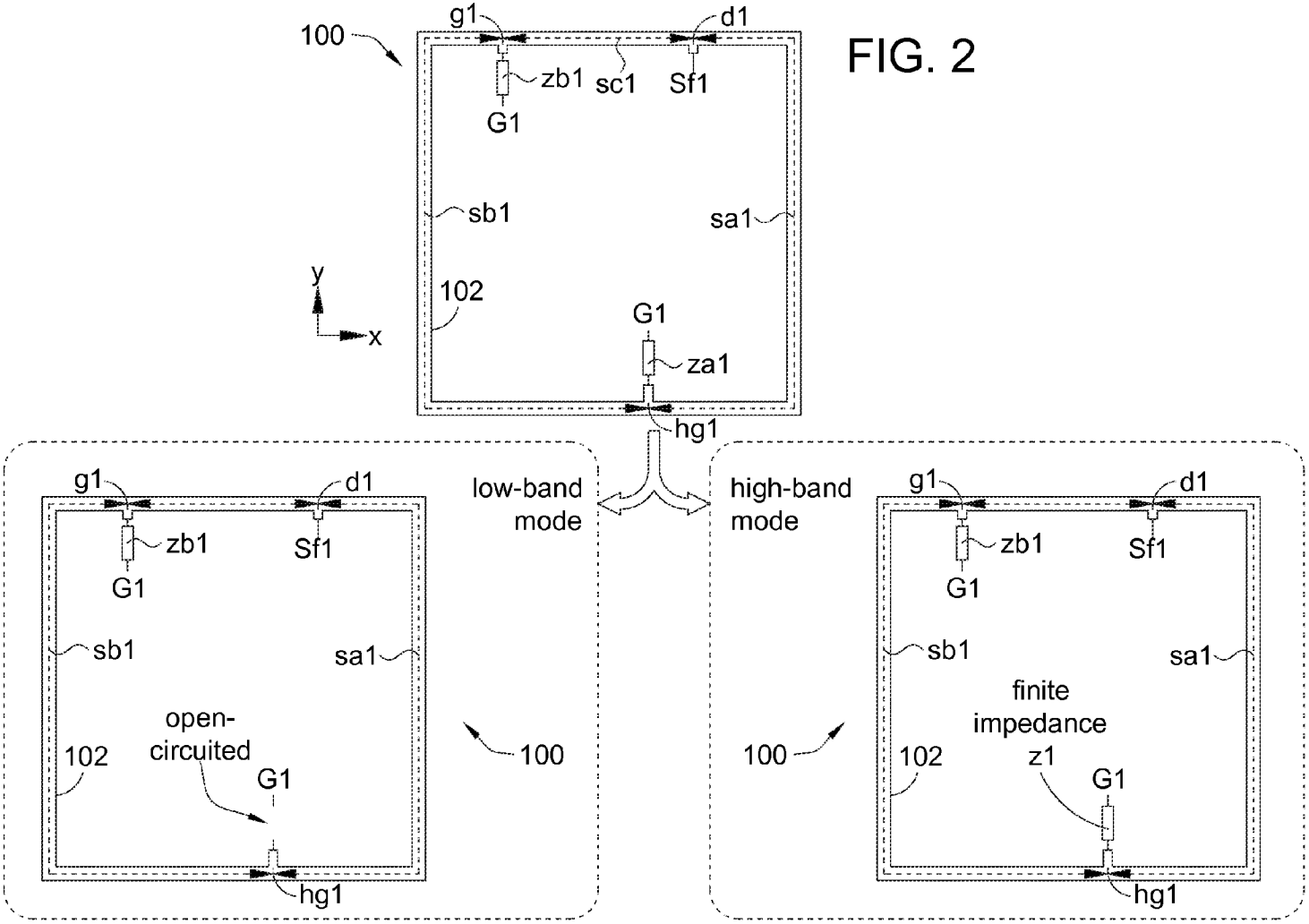
FIG. 2 schematically illustrates electrical arrangement and operations of the antenna structure shown in FIG. 1.

Please refer to FIG. 1 and FIG. 2; FIG. 1 illustrates an antenna structure 100 according to an implementation of the disclosure, FIG. 2 demonstrates a planar view of the antenna structure 100 and schematically illustrates electrical arrangement and operations of the antenna structure 100. As shown in FIG. 1, the antenna structure 100 may be implemented by a loop 102, which may be a periphery of a metallic case of an electronic product 10, so the antenna structure 100 may be embedded in the product 10. The loop 102 may be a closed loop surrounding an opening 104, which may form a vacancy for containing a core assembly 112 of the product 10; for example, the core assembly 112 may include a display panel (or touch screen) 110 and a circuit board (e.g., PCB, print circuit board) 106, with one or more electrical building blocks such as 108*a*, 108*b* and 108*c* mounted on the circuit board 106. For example, the electrical building blocks may include integrated circuit(s), CPU (central processing unit), controller(s), processor(s), volatile and/or non-volatile memory module(s), microphone(s), speaker(s), sensor(s), power supply unit and/or component(s) like transistor(s), inductor(s), resistor(s) and/or capacitor(s), etc. The circuit board 106 may include multiple conductive (metal) layers insulated to each other by dielectric layer(s) (not shown); one of the conductive layers may be a ground plane G1 kept at a ground potential (voltage), so the electrical building blocks may be electrically grounded to the ground plane G1, while other conductive layer(s) (not shown) may implement routing (wires, traces, rails, etc.) for the electrical building blocks to relay power voltage(s) and signals.

The antenna structure 100 may include terminals d1, hg1 and g1, and conductive sections sa1, sb1 and sc1. As different portions of the loop 102 which may surround the ground plane G1, the conductive section sa1, or head section, may extend from the terminal d1 to the terminal hg1 along the loop 102, the conductive section sb1, or intermediate section, may extend from the terminal hg1 to the terminal g1 along the loop 102, and the conductive section sc1, or tail section, may extend from the terminal g1 to the feed terminal d1 along the loop 102. Hence, the conductive sections sa1, sb1 and sc1 may connect to form a complete ring, and it may be unnecessary to arrange dielectric slot(s) or gap(s) for separating (insulating) two adjacent sections; in other words, the conductive sections sa1 and sb1 may be conductively connected, the conductive sections sb1 and sc1 may be conductively connected, and/or, the conductive sections sc1 and sa1 may be conductively connected.

As shown in FIG. 2, the terminal d1 may be a feed terminal for connecting a feed signal Sf1 (FIG. 2), and the terminal g1 may be a grounding terminal (tail grounding terminal) for connecting the ground plane G1 via an impedance zb1 (tail impedance). The terminal hg1 (intermediate grounding terminal) may conduct to the ground plane G1 via an impedance z1 (intermediate impedance) during a second operation mode, and cease conducting via the impedance z1 during a first operation mode. For example, the first operation mode may be a low-band mode for receiving and/or transmitting wireless signals of low frequency, while the second operation mode may be a high-band mode for receiving and/or transmitting wireless signals of high frequency. The terminal hg1 may connect the ground plane G1 via a switching circuit za1 which is capable of selectively providing different impedances respectively for the first and second operation modes. For example, during the first operation (low-band) mode, the switching circuit za1 may provide an excessive (infinite) impedance, causing the terminal hg1 to be open-circuited; on the other hand, during the second operation (high-band) mode, the switching circuit za1 may provide a finite impedance z1 between the terminal hg1 and the ground plane G1.

Figures 3A, 3B:
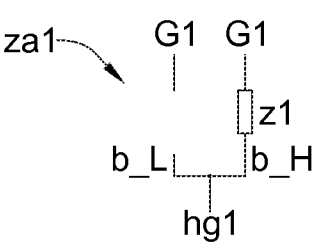
FIG. 3*a* and FIG. 3*b* illustrate implementations of a switching circuit shown in FIG. 1.

Along with FIG. 2, please refer to FIG. 3*a* and FIG. 3*b* respectively illustrating different implementations of the switching circuit za1. In FIG. 3*a*, the switching circuit za1 may include a switch sw1 and the impedance z1 serially connected between the terminal hg1 and the ground plane G1. During the first operation (low-band) mode, the switch sw1 may turn off to stop conducting, so the terminal hg1 may be insulated from the ground plane G1; on the other hand, during the second operation (high-band) mode, the switch sw1 may turn on to maintain conducting, so the terminal hg1 may be conducted to the ground plane G1 via the impedance z1.

In FIG. 3*b*, the switching circuit za1 may be implemented by a diplexer which may include two frequency-selective branches b_L and b_H respectively for low frequency and high frequency, so the terminal hg1 may experience impedance of the frequency-selective branch b_L at low frequency, and experience impedance of the frequency-selective branch b_H at high frequency. The frequency-selective branch b_L may be kept insulated from the ground plane G1, hence the terminal hg1 may be open-circuited during the first operation (low-band) mode; on the other hand, the frequency-selective branch b_H may connect the ground plane G1 via the impedance z1, then the terminal hg1 may interface the impedance z1 during the second operation mode.

Figure 5A:
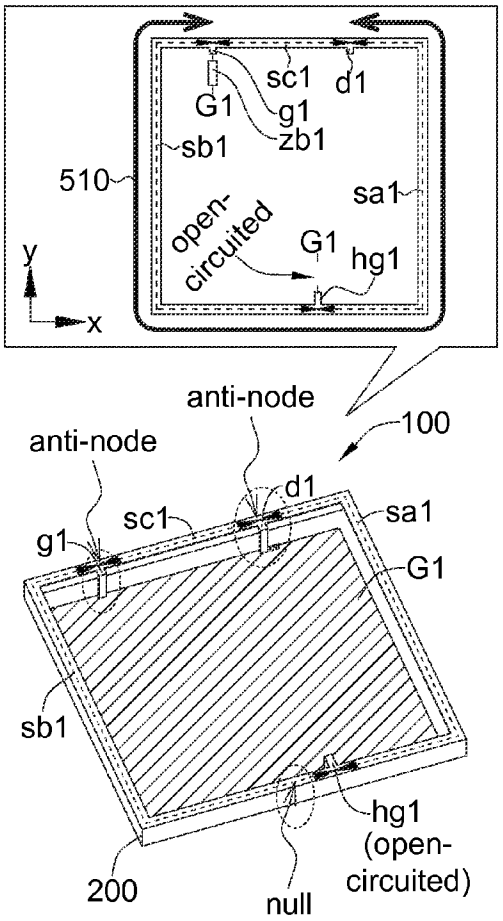
FIG. 5*a* to FIG. 5*c* illustrate operations and related resonances of the antenna structure shown in FIG. 1.
Figure 5B:
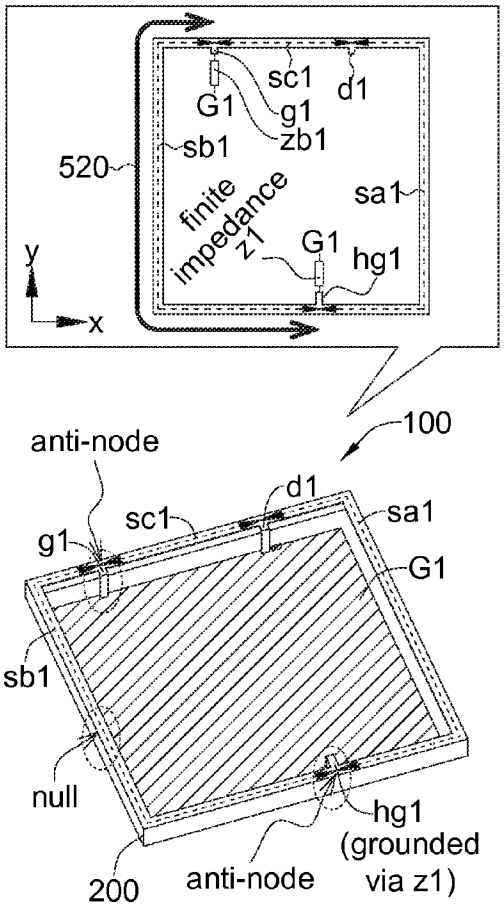
Figure 5C:
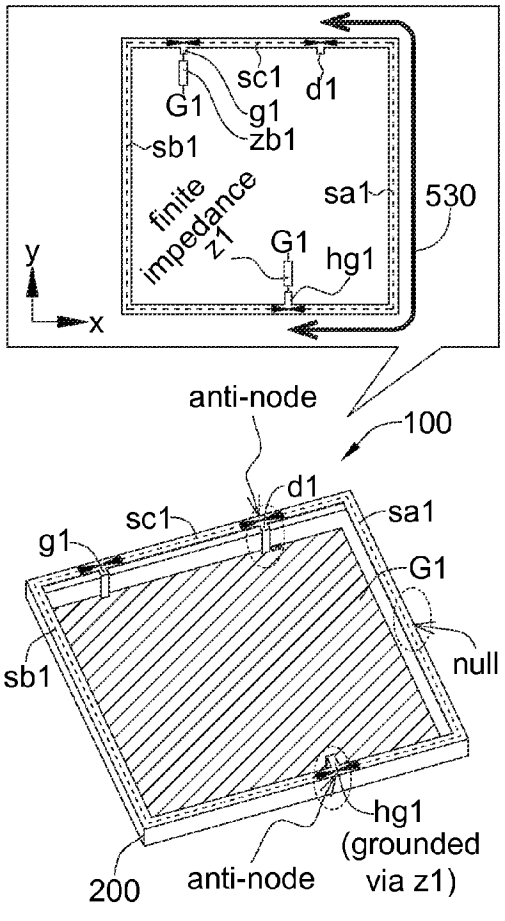

Along with FIG. 1 and FIG. 2, please refer to FIG. 5*a* to FIG. 5*c* illustrating operations of the antenna structure 100. As shown in FIG. 5*a*, in the first operation (low-band) mode described in FIG. 2, the terminal hg1 may be open-circuited without being grounded to the ground plane G1, so the antenna structure 100 may rely on the conductive sections sa1 and sb1 to form a conductive path 510 between the terminal d1 and the grounding terminal g1 for distribution of current. Since the conductive path 510 jointly formed by the sections sa1 and sb1 is longer than individual length of the section sa1 or sb1, it may support a first electromagnetic resonance of a longer wavelength for wireless signaling of lower frequency (low-band).

On the other hand, as shown in FIG. 5*b* and FIG. 5*c*, in the second operation (high-band) mode described in FIG. 2, not only the terminal g1 is grounded via the impedance zb1, but also the terminal hg1 is grounded to the ground plane G1 via the impedance z1; hence, the conductive section sa1 forming a conductive path 530 (FIG. 5*c*) between the terminal d1 and the terminal hg1 may support a third electromagnetic resonance, and the conductive section sb1 forming another conductive path 520 (FIG. 5*b*) between the terminal hg1 and the terminal g1 may support a second electromagnetic resonance. Because each of the two conductive paths 530 and 520 respectively formed by the individual conductive sections sa1 and sb1 in the second operation mode is shorter than the conductive path 510 jointly formed by both the conductive sections sa1 and sb1 in the first operation mode, the second and third electromagnetic resonances in the second operation mode are of shorter wavelengths, and may therefore be utilized for wireless signaling of higher frequencies (high-band).

Electromagnetic resonance for wireless signaling may be understood by geometrical locations of anti-node(s) and null(s) of electrical current distribution, wherein the current distribution may reach maximum magnitude at each anti-node, and reach minimum magnitude at each null. As shown in FIG. 5*a*, during the first operation mode when the terminal hg1 is not grounded, the first electromagnetic resonance of the path 510 may be a half-wave resonance with two anti-nodes respectively at the terminals d1 and g1; the joint length of conductive sections sa1 and sb1 (i.e., length of the path 510) may therefore relate to a half of wavelength of the first electromagnetic resonance, wherein there may only be a single null at the middle of the conductive path 510, and may not be other anti-nodes located between the terminals d1 and g1 on the conductive sections sa1 and sb1.

As shown in FIG. 5*b*, during the second operation mode when the terminal hg1 is grounded via the impedance z1, the second electromagnetic resonance of the path 520 may be a half-wave resonance with two anti-nodes respectively at the terminals hg1 and g1; in other words, length of the conductive sections sb1 may relate to a half of wavelength of the second electromagnetic resonance, wherein there may only be a single null located halfway between the terminals hg1 and g1 along the conductive sections sb1.

As shown in FIG. 5*c*, also during the second operation mode, the third electromagnetic resonance of the path 530 may be a half-wave resonance with two anti-nodes respectively at the terminals d1 and hg1, the length of conductive sections sa1 may therefore relate to a half of wavelength of the third electromagnetic resonance, wherein there may only be a single null located halfway between the terminals d1 and hg1 along the conductive sections sa1.

According to FIG. 5*a* to FIG. 5*c*, controlling lengths of the conductive sections sa1 and sb1 may be beneficial for adjusting and/or tuning characteristics (e.g., frequency domain locations) of the RF bands supportable by the antenna structure 100. Although consideration of product design may already dominate determination of dimensions of the loop 102 for the loop 102 may be periphery of the product 10 (FIG. 1), however, lengths of the conductive sections sa1 and sb1 may be adjusted without modifying the dimensions of the loop 102.

Figure 4:
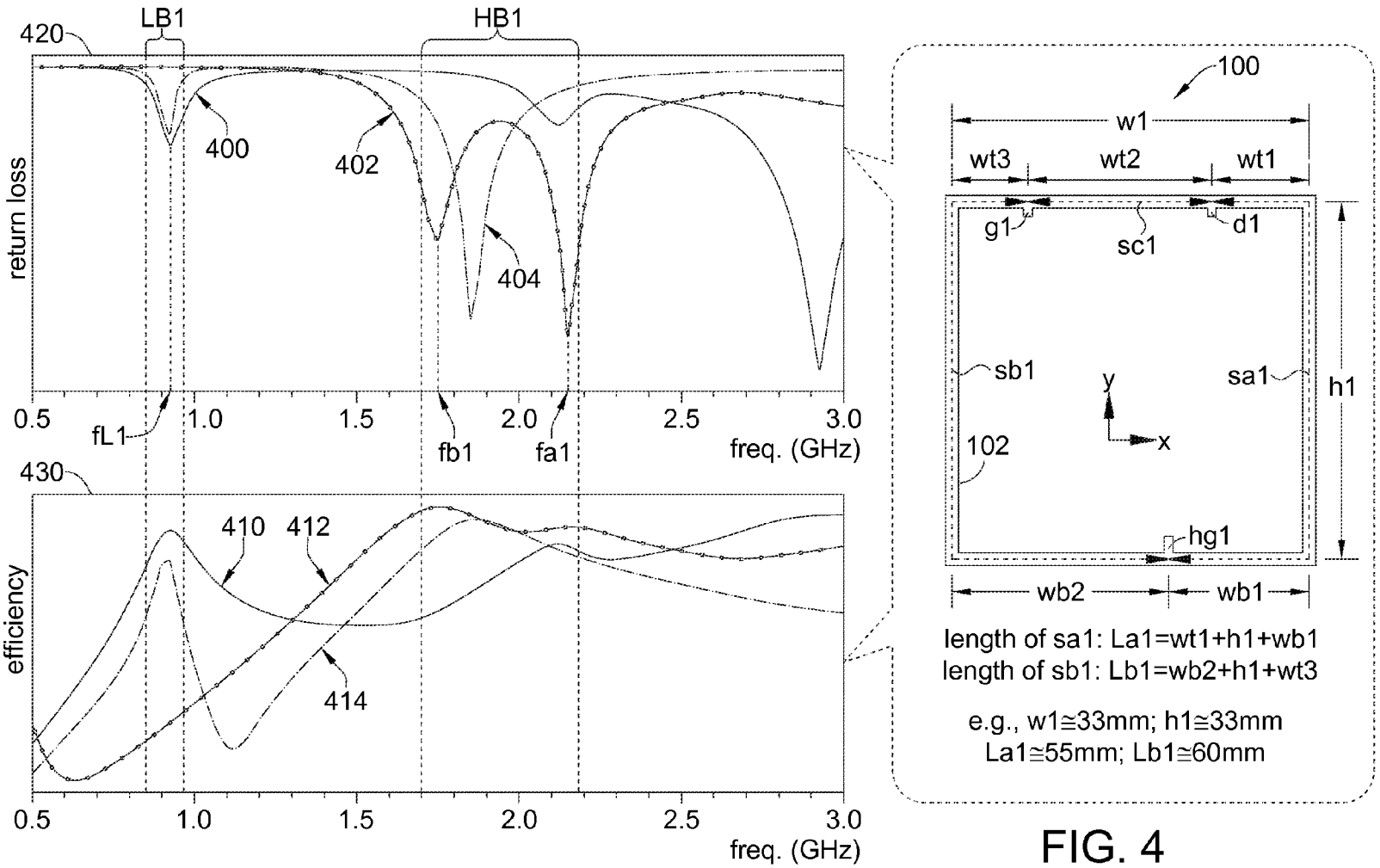
FIG. 4 illustrates exemplary performances/characteristics of the antenna structure shown in FIG. 1.

Along with FIG. 1 and FIG. 2, please refer to FIG. 4 illustrating dimensioning of the conductive sections sa1 and sb1 under given dimensions (e.g., a width w1 and a height h1) of the loop 102 for achieving RF bands LB1 and HB1 compliant to mobile telecommunication, wherein the compliance may be proved by return loss and efficiency respectively shown in plots 420 and 430. The transverse axis of the plots 420 and 430 is frequency (in GHz), the longitudinal axis of the plot 420 is magnitude of return loss (in dB), and the longitudinal axis of the plot 430 is magnitude of efficiency.

The plot 420 includes curves 400, 402 and 404; the curve 400 describes how return loss of the antenna structure 100 varies with frequency during the first operation mode, and the curve 402 describes how return loss of the antenna structure 100 varies with frequency during the second operation mode; for comparison, the curve 404 describes how return loss of a planar inverted F antenna (PIFA) varies with frequency, with the PIFA grounded to a ground plane dimensioned the same as the ground plane G1 (FIG. 1) of the antenna structure 100. For example, the PIFA may be similar to an antenna 800 shown in FIG. 8, wherein the antenna 800 may include a feed terminal d0 for connecting a feed signal (not shown), a grounding terminal g0 for directly connecting to a ground plane G0, along with two conductive arms sa0 and sb0 respectively diverging toward two different directions from the feed terminal d0 to two separate (unconnected) ends ea0 and eb0.

The plot 430 includes curves 410, 412 and 414; the curve 410 describes how efficiency of the antenna structure 100 varies with frequency during the first operation mode, the curve 412 describes how efficiency of the antenna structure 100 varies with frequency during the second operation mode; and the curve 414 describes how return loss of the planar inverted F antenna (PIFA) varies with frequency for comparison. In an implementation, the RF band LB1 may cover GSM-900 around 900 MHz, and the RF band HB1 may cover GSM-1800 (DCS), GSM-1900 (PCS) and/or GSM band 1 (for WCDMA) around 1800 MHz and 1900 MHz.

Even when the width w1 and the height h1 of the loop 102 may already be decided based on product design, the antenna structure 100 may allow sufficient flexibility for antenna design to manipulate antenna performances and/or characteristics, since lengths of the conductive sections sa1 and sb1 may be adjusted, without compromising the dimensions of the loop 102, by placing the terminals d1, hg1 and g1. As shown in a planar view at right-hand side of FIG. 4, a length La1 of the conductive section sa1 may equal (wt1+h1+wb1), and a length Lb1 of the conductive section sb1 may equal (wb2+h1+wt3), wherein the lengths wt1, wt3 and wb1, wb2 are determined by geometrical locations of the terminals d1, hg1 and g1. During the first operation (low-band) mode, a joint length (La1+Lb1) of the conductive sections sa1 and sb1 may relate to a frequency fL1 where the curve 400 reaches a notch. On the other hand, during the second operation (high-band) mode, the lengths La1 and Lb1 of the conductive sections sa1 and sb1 may respectively relate to frequencies fa1 and fb1 where the curve 402 reaches notches. By properly placing the terminals d1, hg1 and g1 to set lengths La1 and Lb1 of the conductive sections sa1 and sb1, the frequency fL1 may be positioned within a range of the RF band LB1 to support the RF band LB1, and frequencies fa1 and fb1 may be positioned within a range of the RF band HB1 to jointly support the RF band HB1; accordingly, the antenna structure 100 may successfully support wireless signaling at the compliant RF bands LB1 and HB1.

For example, the width w1 and the height h1 may be set to approximate 33 mm for product design of a smart watch. For antenna design enabling the smart watch to wirelessly signal at the RF bands LB1 and HB1, the lengths La1 and Lb1 may respectively be set to approximate 55 mm and 60 mm.

Figure 8:
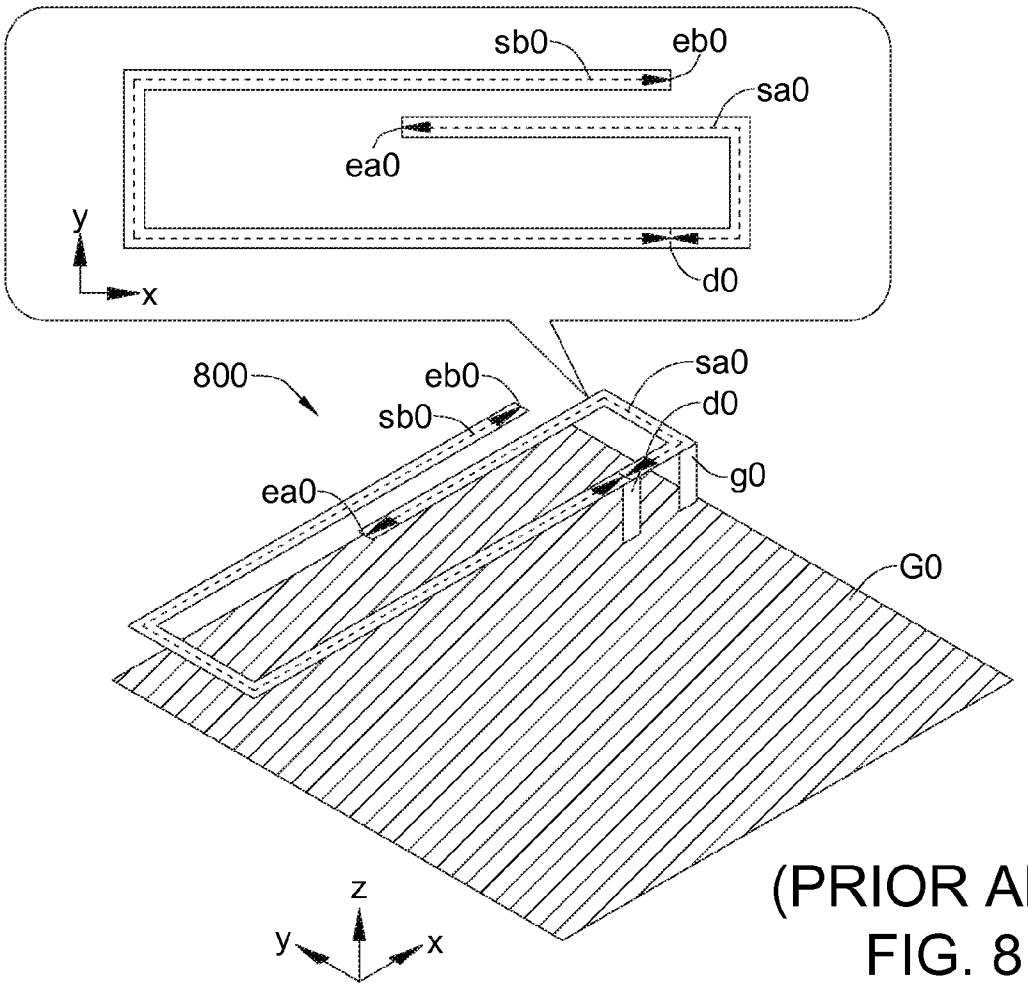
(PRIOR ART) FIG. 8
FIG. 8 illustrates a conventional antenna structure.

According to comparisons shown in the plots 420 and 430, bandwidth of the antenna structure 100 may be advantageously broader than that of the conventional antenna 800 shown in FIG. 8.

According to FIG. 5*b* and FIG. 5*c*, each of the conductive sections sa1 and sb1 of the antenna structure 100 may support a resonance during the second operation (high-band) mode; furthermore, as shown in FIG. 5*a*, the conductive sections sa1 and sb1 may also jointly support a resonance during the first operation (low-band) mode. In other words, the conductive sections sa1 and sb1 of the antenna structure 100 may be reused to support different resonances during different operation modes. On the contrary, while the antenna 800 shown in FIG. 8 may also achieve wireless signaling of two different RF bands, each of the conductive arms sa0 and sb0 only supports a single resonance of a single band; the conductive arms sa0 and sb0 are not to be jointly reused for additional band.

In an implementation, the length Lb1 of the conductive section sb1 and a length of the conductive section sc1 (equal to a length wt2 in the example of FIG. 4) may be arranged to cause the second electromagnetic resonance (FIG. 5*b*) to overpower electromagnetic resonance supported by the conductive section sc1, so the second electromagnetic resonance may be dominantly stronger comparing to the electromagnetic resonance of the conductive section sc1. For example, in an implementation, the length Lb1 of the conductive section sb1 may be longer than a sum of a length of the conductive section sc1 and the length La1 of the conductive section sa1. In an implementation, the length Lb1 of the conductive section sb1 may be longer than the length La1 of the conductive section sa1, and also be longer than the length of the conductive section sc1.

Figure 6:
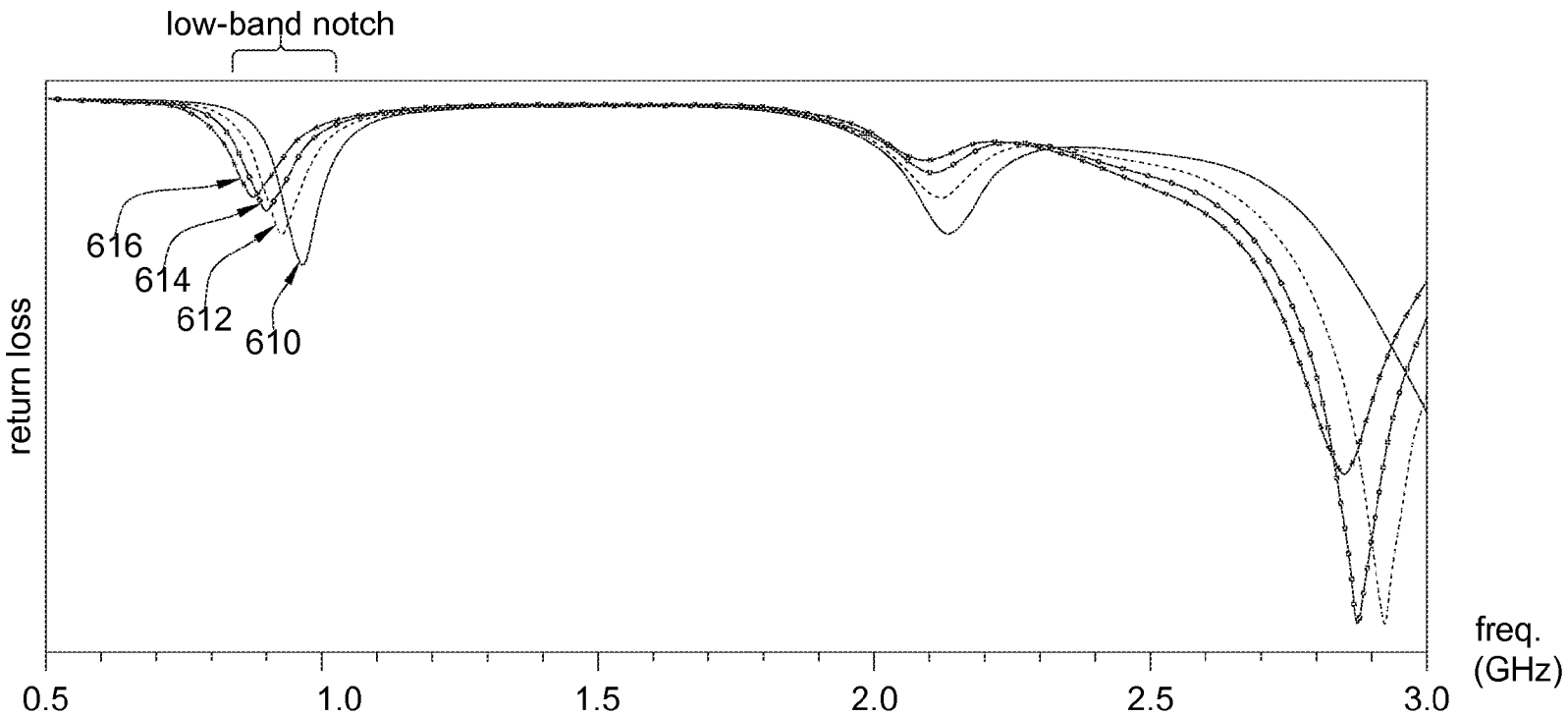
FIG. 6 exemplarily illustrates tuning performances/characteristics of the antenna structure shown in FIG. 1 by adjusting value of an impedance shown in FIG. 2.

In addition to lengths of the conductive sections sa1 and sb1, the impedances z1 and zb1 (FIG. 2) may be utilized for flexibility of tuning performances and/or characteristics of the antenna structure 100. In an implementation, the impedance zb1 between the terminal g1 and the ground plane G1 may be inductive, e.g., be implemented by an inductor. Along with FIG. 2, please refer to FIG. 6 illustrating how performances and/or characteristics of the antenna 100 may be adjusted by changing value (e.g., inductance) of the impedance zb1. The transverse axis of FIG. 6 is frequency (in GHz), and the longitudinal axis is magnitude of return loss (in dB). The curve 610 may reflect frequency dependency of return loss during the first operation (low-band) mode when the inductance of the impedance zb1 equals a first value zb1_1 (not shown in FIG. 6); similarly, the curve 612, 614 and 616 may reflect frequency dependency of return loss during the first operation (low-band) mode when the inductance of the impedance zb1 respectively equals a second value zb1_2, a third value zb1_3 and a fourth value zb1_4 (not shown in FIG. 6), wherein the values zb1_1 to zb1_4 may be incremental, i.e., zb1_1<zb1_2<zb1_3<zb1_4. As shown in FIG. 6, a low-band notch of the return loss may be shifted toward lower frequency as the impedance zb1 increases. In other words, by increasing value (e.g., inductance) of the impedance zb1, frequency domain location of the low-band notch, which may be utilized as the band LB1 shown in FIG. 4, may be tuned toward lower frequency.

Figure 7:
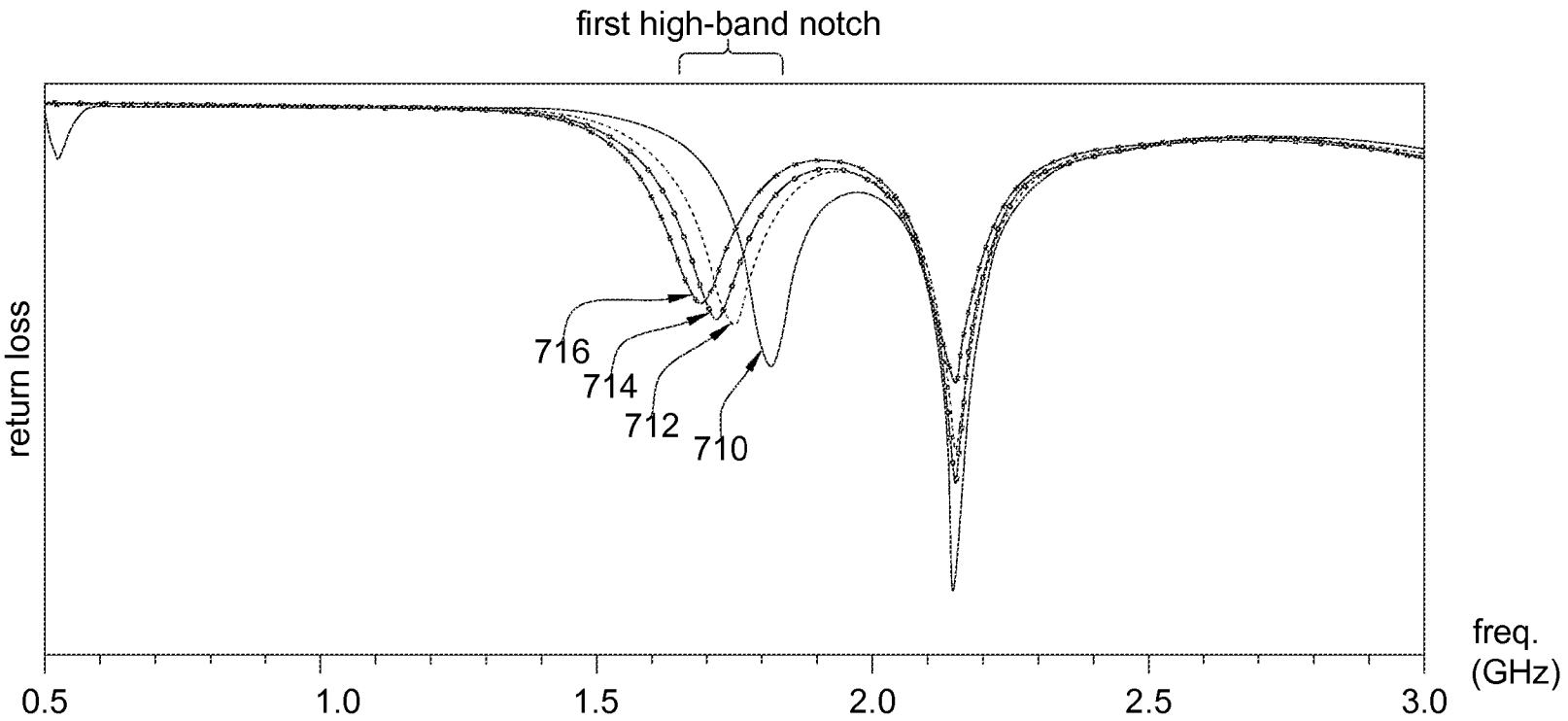
FIG. 7 exemplarily illustrates tuning performances/characteristics of the antenna structure shown in FIG. 1 by adjusting value of another impedance shown in FIG. 2.

In an implementation, the impedance z1 (FIG. 2) between the terminal hg1 and the ground plane G1 during the second operation (high-band) mode may be capacitive, e.g., be implemented by a capacitor. Along with FIG. 2, please refer to FIG. 7 illustrating how performances and/or characteristics of the antenna 100 may be adjusted by changing value (e.g., capacitance) of the impedance z1. The transverse axis of FIG. 7 is frequency (in GHz), and the longitudinal axis is magnitude of return loss (in dB). The curve 710 may reflect a frequency dependency of return loss during the second operation (high-band) mode when the capacitance of the impedance z1 equals a first value z1_1 (not shown in FIG. 7); similarly, the curve 712, 714 and 716 may reflect frequency dependency of return loss during the second operation mode when the capacitance of the impedance z1 respectively equals a second value z1_2, a third value z1_3 and a fourth value z1_4 (not shown in FIG. 6), wherein the values z1_1 to z1_4 may be incremental, i.e., z1_1<z1_2<z1_3<z1_4. As shown in FIG. 7, a first high-band notch of the return loss may be shifted toward lower frequency as the impedance z1 increases. In other words, by increasing value (e.g., capacitance) of the impedance z1, frequency domain location of the first high-band notch, which may serve as a lower portion of the band HB1 shown in FIG. 4, may be tuned toward lower frequency.

As demonstrated by FIG. 6 and FIG. 7, modifying the impedance(s) zb1 and/or z1 may provide beneficial flexibility for antenna design to tune performances and/or characteristics of the antenna structure 100, even after geometric locations of the terminals d1, hg1 and g1 (and therefore lengths of the conductive sections sa1 and sb1) have been decided and are not allowed to be changed.

Figure 9:
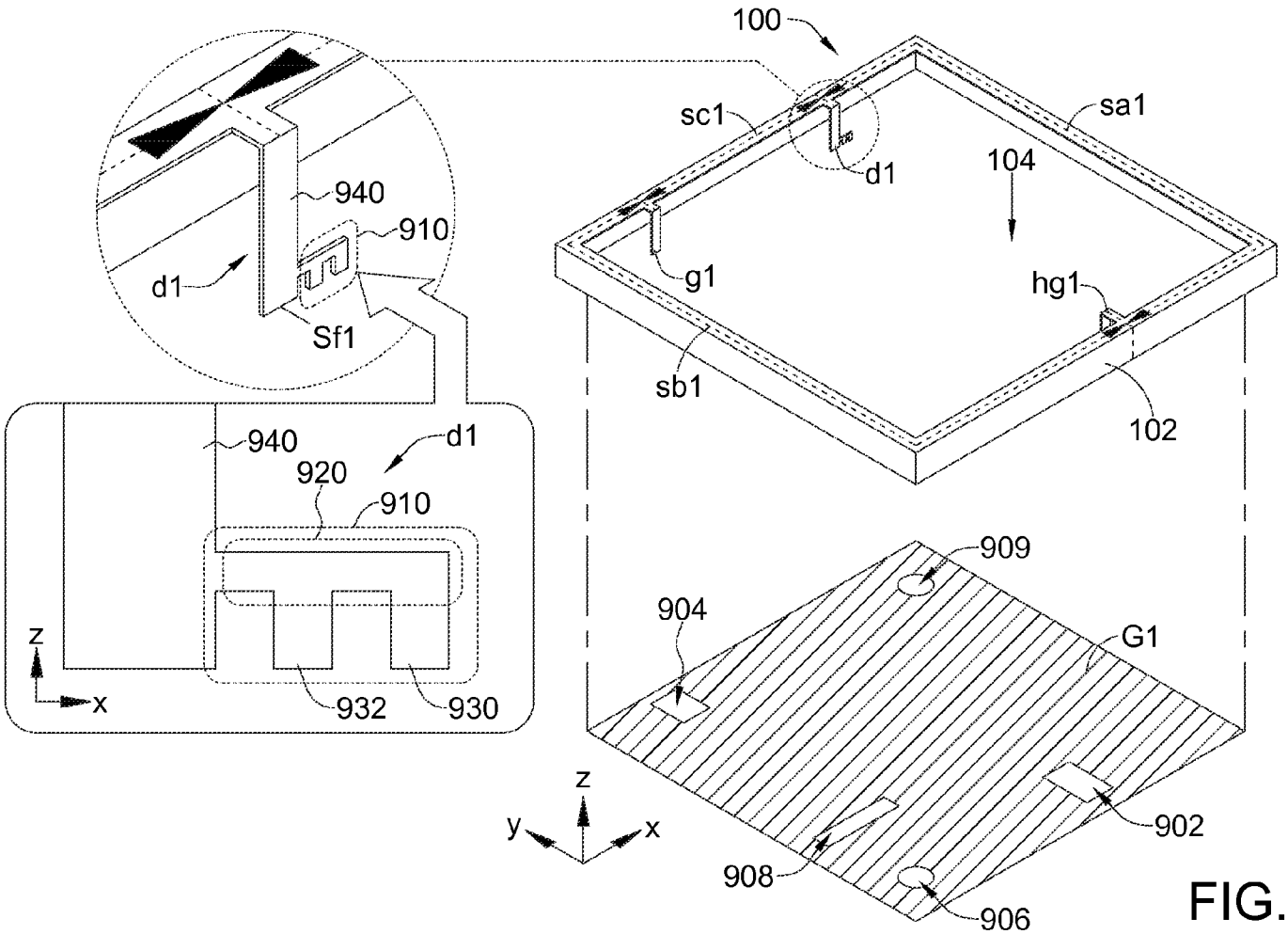
FIG. 9 illustrates exemplary details of the antenna structure shown in FIG. 1.

Along with FIG. 1, please refer to FIG. 9 illustrating some possible details of the antenna structure 100. In an implementation, the feed terminal d1 may include a main portion 940 and a stub 910 attached to the main portion 940. The terminal d1 may connect to the feed signal Sf1 at the main portion 940. The stub 910 may include a primary branch 920 extending outward along a first direction (e.g., x-axis as labeled in FIG. 9), as well as one or more secondary branches, such as the branches 930 and 932, extending from the primary branch 920 outward along a second direction (e.g., z-axis), wherein the first direction and the second direction may be different. Geometric locations and/or dimensions of the stub 910 (e.g., how long the branches 920, 930 and/or 932 will extend) may be adjusted to tune performances and/or characteristics of the antenna structure 100, e.g., impedance matching of the feed terminal d1.

In an implementation, the ground plane G1 may include one or more openings, such as openings 902, 904, 906, 908 and 909, for various purposes. For example, the opening 902 may locate near the terminal hg1 for providing vacancy to contain at least a portion of the switching circuit za1 (FIG. 2); similarly, the opening 904 may locate near the terminal g1 providing vacancy to contain at least a portion of the impedance zb1. Other opening(s) may serve various purposes; for example, one or more openings may be utilized to contain via(s) interconnecting different conductive layers (not shown) of the circuit board 106 (FIG. 1), one or more openings may be utilized to contain mechanical structures such as mounting bosses.

Though the loop 102 of the antenna 100 shown in FIG. 1 and FIG. 2 is rectangular, the loop 102 may be of other shape, such as: rectangle with chamfered and/or filleted corner(s), polygon of any number of sides, polygon with chamfered and/or filleted corner(s), oval, ellipse or circle, etc.

Figure 10:
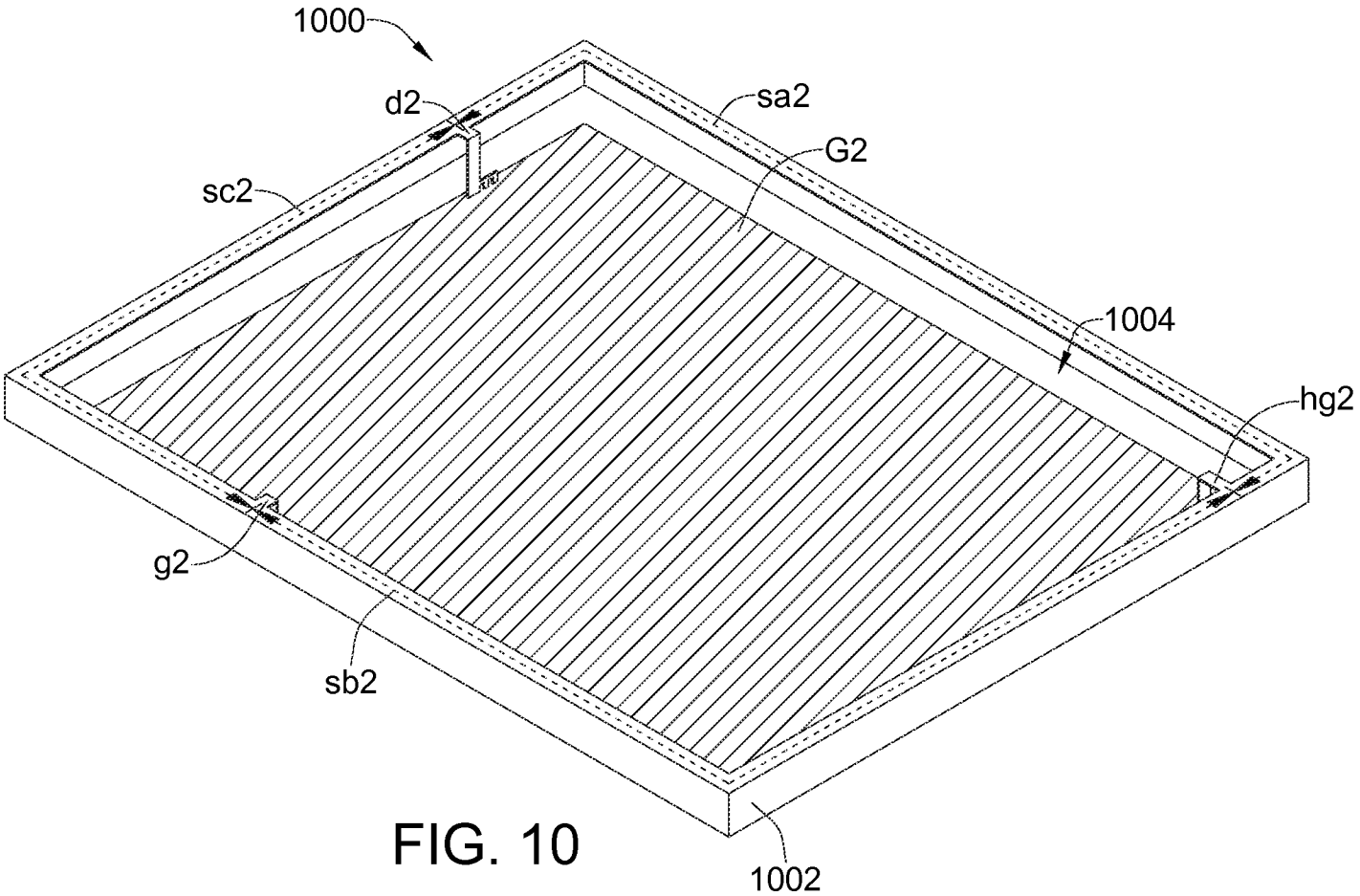
FIG. 10 illustrates an antenna structure according to an implementation of the disclosure.
Figure 11:
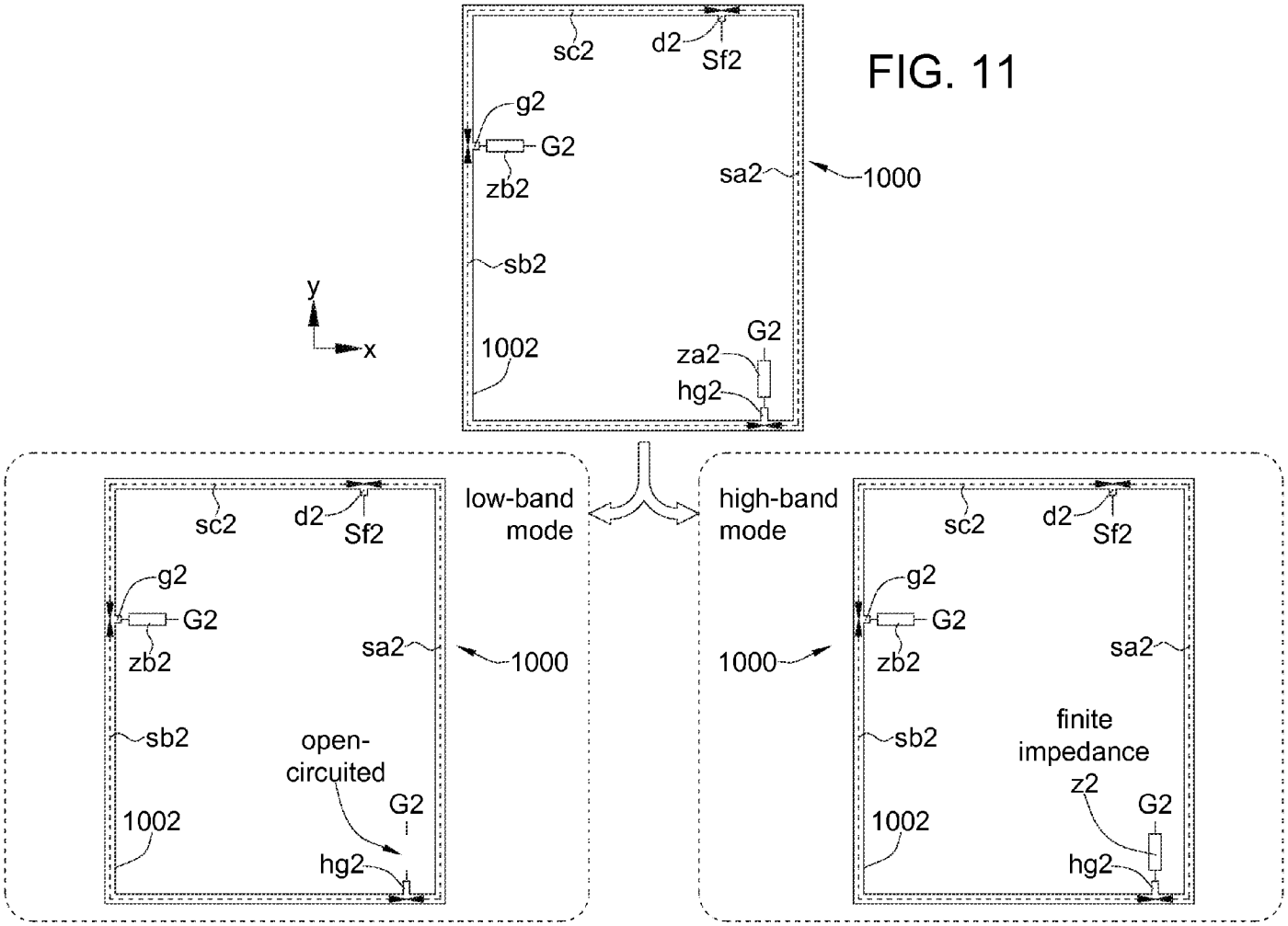
FIG. 11 illustrates electrical arrangement and operations of the antenna structure shown in FIG. 10.

Please refer to FIG. 10 and FIG. 11; FIG. 10 illustrates an antenna structure 1000 according to an implementation of the disclosure, FIG. 11 demonstrates a planar view of the antenna structure 1000 and schematically illustrates electrical arrangement and operations of the antenna structure 1000. Similar to the antenna structure 100 shown in FIG. 1, the antenna structure 1000 in FIG. 10 may be implemented by a loop 1002, which may be a periphery of a metallic case of an electronic product (not shown). The loop 1002 may be a closed loop surrounding an opening 1004.

The antenna structure 1000 may include terminals d2, hg2 and g2, and conductive sections sa2, sb2 and sc2. The conductive sections sa2, sb2 and sc2 may be different portions of the loop 1002, and surround a ground plane G2 in the opening 1004. The conductive section sa2 (head section) may extend between the terminals d2 and hg2 along the loop 1002, the conductive section sb2 (intermediate section) may extend between the terminals hg2 and g2 along the loop 1002, and the conductive section sc2 (tail section) may extend between the terminals g2 and terminal d2 along the loop 1002. The conductive sections sa2, sb2 and sc2 may therefore connect to form a complete ring, and it may be unnecessary to arrange dielectric slot(s) or gap(s) for separating (insulating) two adjacent sections; in other words, the conductive sections sa2 and sb2 may be conductively connected, the conductive sections sb2 and sc2 may be conductively connected, and/or, the conductive sections sc2 and sa2 may be conductively connected.

As shown in FIG. 11, the terminal d2 may be a feed terminal for connecting a feed signal Sf2, and the terminal g2 may be a grounding terminal (tail grounding terminal) for connecting the ground plane G2 via an impedance zb2 (tail impedance). The terminal hg2 (intermediate grounding terminal) may conduct to the ground plane G2 via a finite impedance z2 (intermediate impedance) during a second operation (e.g., high-band) mode, and cease conducting via the impedance z2 during a first operation (e.g., low-band) mode. Similar to the terminal hg1 shown in FIG. 2, the terminal hg2 in FIG. 11 may connect the ground plane G2 via a switching circuit za2, wherein the switching circuit za2 is capable of selectively providing different impedances respectively for the first and second operation modes. For example, during the first operation (low-band) mode, the switching circuit za2 may provide an excessive (infinite) impedance, causing the terminal hg2 to be open-circuited; on the other hand, during the second operation (high-band) mode, the switching circuit za2 may provide a finite impedance z2 between the terminal hg2 and the ground plane G2. The switching circuit za2 may be implemented according to FIG. 3*a* or FIG. 3*b*.

Figure 12C:
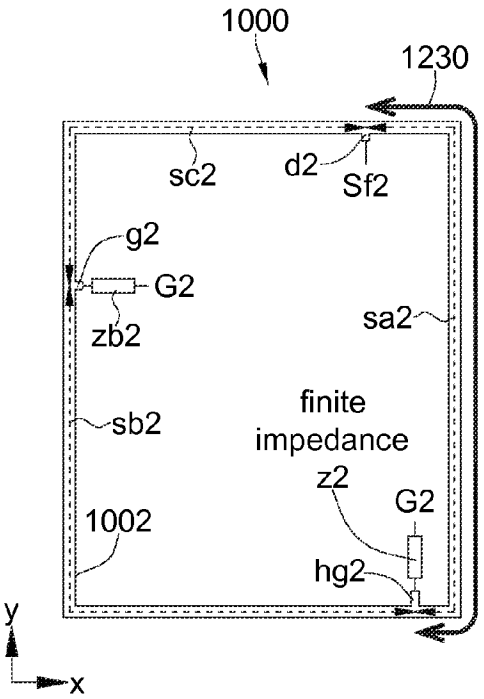
FIG. 12*a* to FIG. 12*c* illustrate operations of the antenna structure shown in FIG. 10.
Figure 12B:
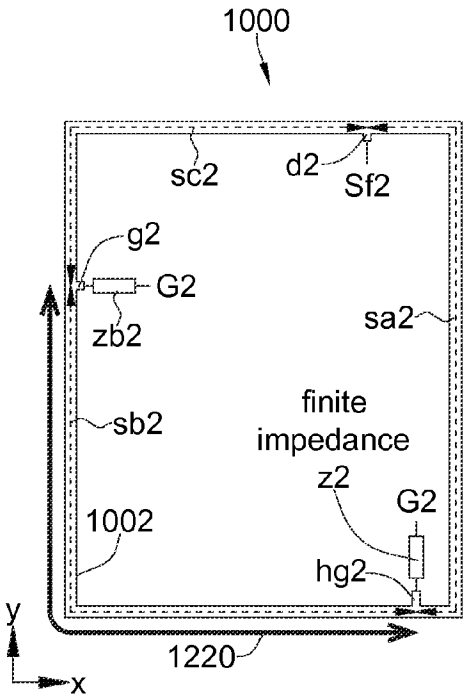
Figure 12A:
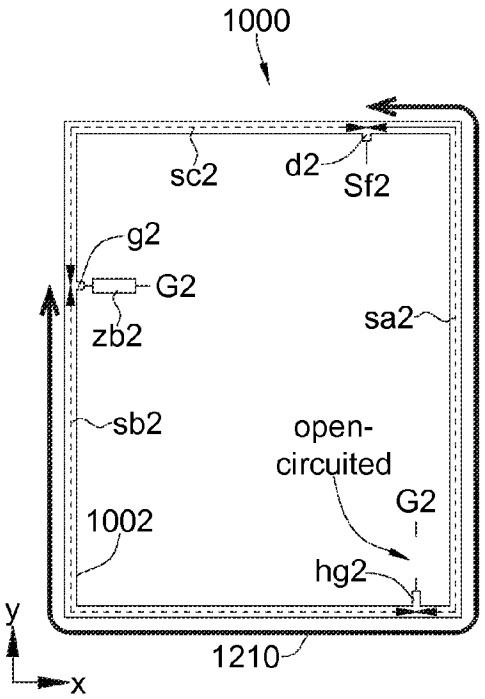

Along with FIG. 10 and FIG. 11, please refer to FIG. 12*a* to FIG. 12*c* illustrating the antenna structure 1000 in different operation modes. According to operations shown in FIG. 11, in the first operation mode, the terminal hg2 may be open-circuited without being grounded to the ground plane G2, so the antenna structure 1000 may rely on the conductive sections sa2 and sb2 to collectively form a conductive path 1210 between the terminal d2 and the grounding terminal g2 for distribution of current, as shown in FIG. 12*a*. Since the conductive path 1210 jointly formed by the conductive sections sa2 and sb2 is longer than individual length of the conductive section sa2 or sb2, it may support a first electromagnetic resonance of a longer wavelength for wireless signaling of lower frequency (low-band). The first electromagnetic resonance may be a half-wave resonance in which the length of the path 1210 may relate to a half of wavelength of the first electromagnetic resonance. With two anti-nodes (not shown) respectively at the terminals d2 and g2, the half-wave first electromagnetic resonance may only have a single null (not shown) at the middle of the path 1210, and may not have any other anti-node located between the terminals d2 and g2 on the conductive path 1210.

On the other hand, in the second operation mode, both the terminal g2 and hg2 are grounded (respectively via the impedances zb2 and z2), so the conductive section sb2 forming a conductive path 1220 between the terminals hg2 and g2 may support a second electromagnetic resonance, as shown in FIG. 12*b*; furthermore, the conductive section sa2 forming another conductive path 1230 between the terminal d2 and the terminal hg2 may also support another third electromagnetic resonance, as shown in FIG. 12*c*. Because each of the two conductive paths 1220 and 1230 respectively formed by the individual conductive sections sa2 and sb2 in the second operation mode is shorter than the conductive path 1210 jointly formed by the conductive sections sa2 and sb2 in the first operation mode, the second and third electromagnetic resonances in the second operation mode are of shorter wavelengths, and may therefore be utilized for wireless signaling of higher frequencies (high-band).

The second electromagnetic resonance in FIG. 12*b* may be a half-wave resonance in which the length of the conductive section sb2 may relate to a half of wavelength of the second electromagnetic resonance. With two anti-nodes (not shown) respectively at the terminals hg2 and g2, the half-wave second electromagnetic resonance may only have a single null (not shown) occurring at middle of the conductive section sb2, and may not have any other anti-node located between the terminals hg2 and g2 on the conductive section sb2.

The third electromagnetic resonance in FIG. 12*c* may also be a half-wave resonance, in which the length of the conductive section sa2 may relate to a half of wavelength of the third electromagnetic resonance. With two anti-nodes (not shown) respectively at the terminals d2 and hg2, the half-wave third electromagnetic resonance may only have a single null (not shown) occurring at middle of the conductive section sa2, and may not have any other anti-node located between the terminals d2 and hg2 on the conductive section sa2.

Figure 13:
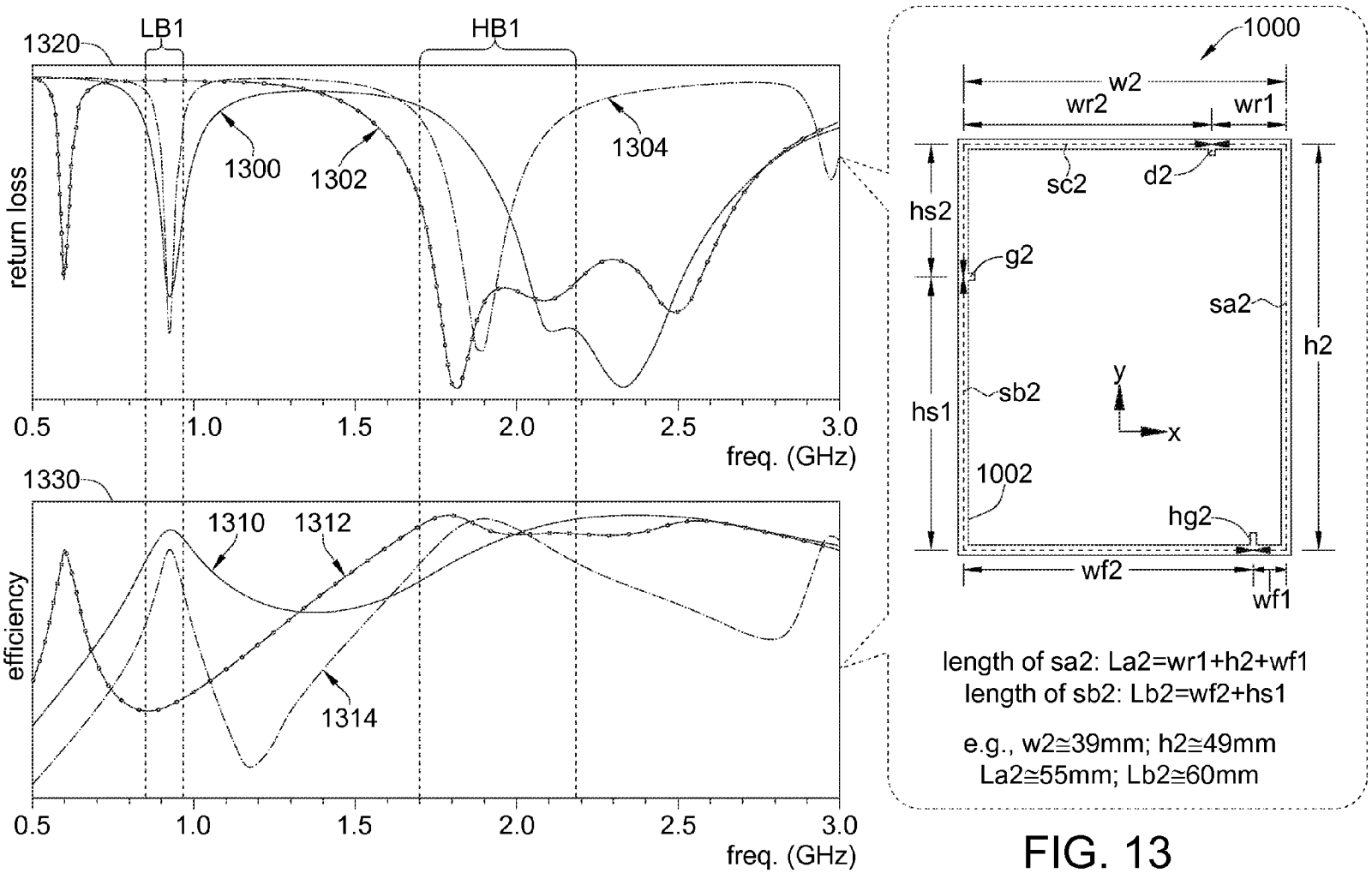
FIG. 13 illustrates exemplary performances/characteristics of the antenna structure shown in FIG. 10.

Continuing FIG. 10 and FIG. 11, please refer to FIG. 13 illustrating dimensioning of the conductive sections sa2 and sb2 for achieving RF bands LB1 and HB1 which may be compliant to mobile telecommunication, wherein the compliance may be understood by return loss and efficiency respectively shown in plots 1320 and 1330. The transverse axis of the plots 1320 and 1330 is frequency (in GHz), the longitudinal axis of the plot 1320 is magnitude of return loss (in dB), and the longitudinal axis of the plot 1330 is magnitude of efficiency. In an implementation, the RF bands LB1 and HB1 in FIG. 13 may be bands for mobile telecommunication, similar to the RF bands LB1 and HB1 shown in FIG. 4; for example, the RF band LB1 in FIG. 13 may cover GSM-900 around 900 MHz, and the RF band HB1 in FIG. 13 may cover GSM-1800 (DCS), GSM-1900 (PCS) and/or GSM band 1 (for WCDMA) around 1800 MHz and 1900 MHz.

As shown in a planar view at right-hand side of FIG. 13, the loop 1002 is of a width w2 and a height h2. For example, as a periphery of a smart watch bigger than the example in FIG. 4, the width w2 and height h2 in FIG. 13 may approximately be 39 mm and 49 mm, respectively. On the other hand, because the RF bands LB1 and HB1 expected to be supported by the antenna 1000 in FIG. 13 may be similar to the RF bands LB1 and HB1 in FIG. 4, a length La2 of the conductive section sa2 of the antenna structure 1000 and a length Lb2 of the conductive section sb2 of the antenna structure 1000 may respectively be expected to approximate 55 mm and 60 mm, similar to setting of the lengths La1 and Lb1 in FIG. 4. To satisfy the expected setting of the lengths La2 and Lb2, the terminals d2, hg2 and g2 may be respectively placed at top side, bottom side and left side of the loop 1002, as shown in FIG. 13. Because placement of the terminals d2, hg2 and g2 may provide flexibility to set additional dimensions (lengths) wr1, wf1 and hs1, the length La2 of the conductive section sa2, which equals (wr1+h2+wf1), may be handily set to match its expected length (e.g., approximate 55 mm); also, the length Lb2 of the conductive section sb2, which equals (wf2+hs1), may be conveniently set to meet its expected length (e.g., approximate 60 mm).

In FIG. 13, the plot 1320 includes curves 1300, 1302 and 1304; the curve 1300 describes frequency dependency of return loss of the antenna structure 1000 during the first operation (low-band) mode, and the curve 1302 describes frequency dependency of return loss of the antenna structure 1000 during the second operation (high-band) mode. For comparison, the curve 1304 describes return loss of a planar inverted F antenna (PIFA), with the PIFA grounded to a ground plane dimensioned the same as the ground plane G2 (FIG. 10) of the antenna structure 1000. The plot 1330 includes curves 1310, 1312 and 1314; the curve 1310 describes frequency dependency of efficiency of the antenna structure 1000 during the first operation mode, and the curve 1312 describes frequency dependency of efficiency of the antenna structure 1000 during the second operation mode. As a comparison, the curve 1314 describes how return loss of the planar inverted F antenna (PIFA) varies with frequency. The plots 1320 and 1330 well verify that antenna structure 1000 is capable of satisfying antenna performances and/or characteristics expected by antenna design, without compromising loop dimensions demanded by product design.

In an implementation, the impedance z2 (FIG. 11) may be capacitive, and the impedance zb2 may be inductive. Similar to the discussion about FIG. 6 and FIG. 7, adjusting value(s) of the impedance z2 and/or the impedance zb2 may provide further flexibility to tune performances and/or characteristics of the antenna structure 1000.

According to the antenna structures 100 (FIG. 1) and 1000 (FIG. 10), it may be understood that the antenna structure of the disclosure may be generally applied to loops of various dimensions to meet requirement of product design, and remain to satisfy demands of antenna design.

Figure 14:
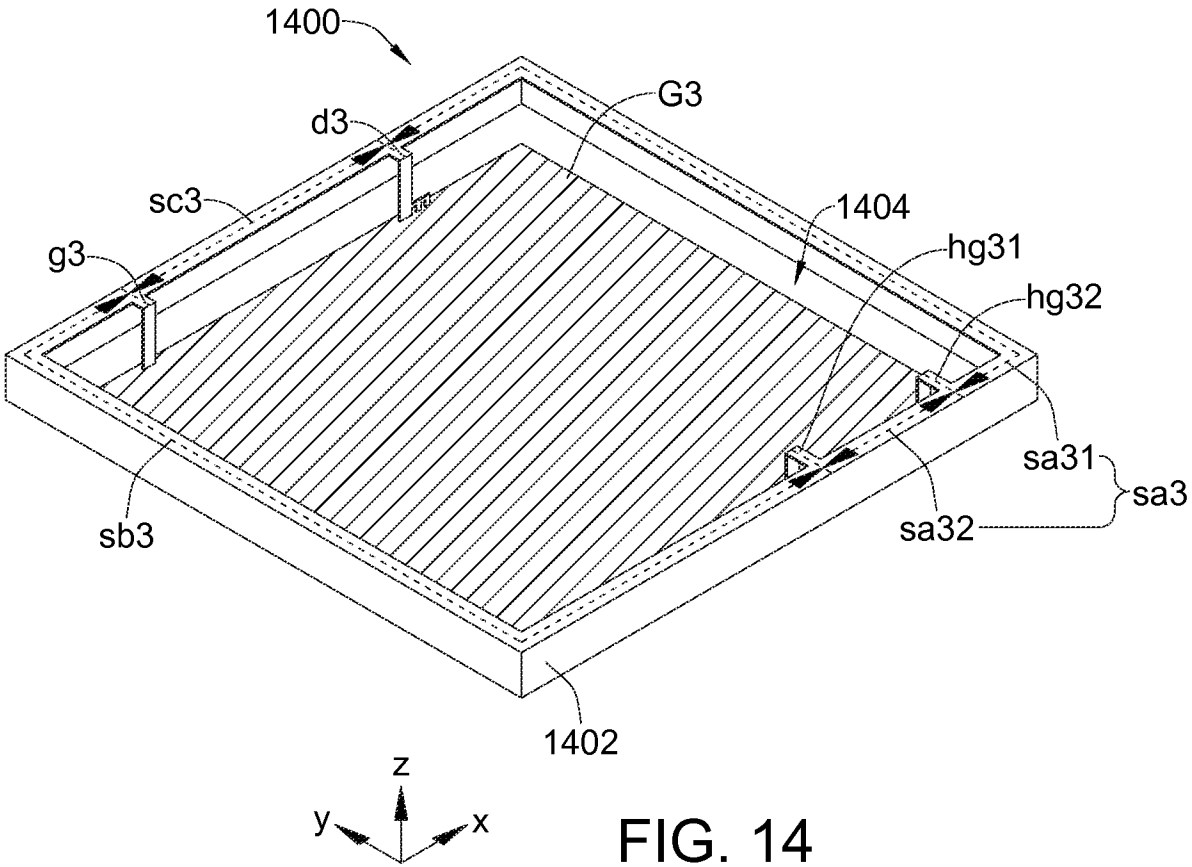
FIG. 14 illustrate an antenna structure according to an implementation of the disclosure.
Figure 15:
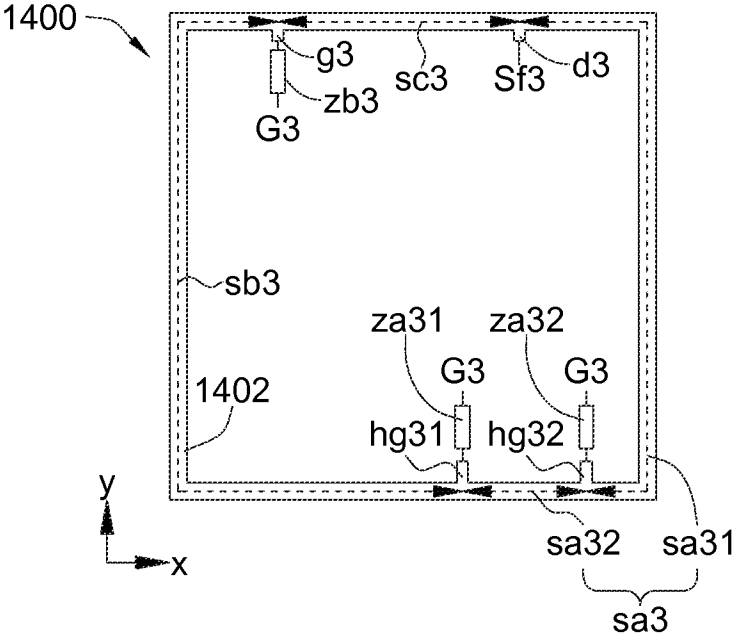
FIG. 15 illustrates electrical arrangement of the antenna structure shown in FIG. 14.
Figure 16A:
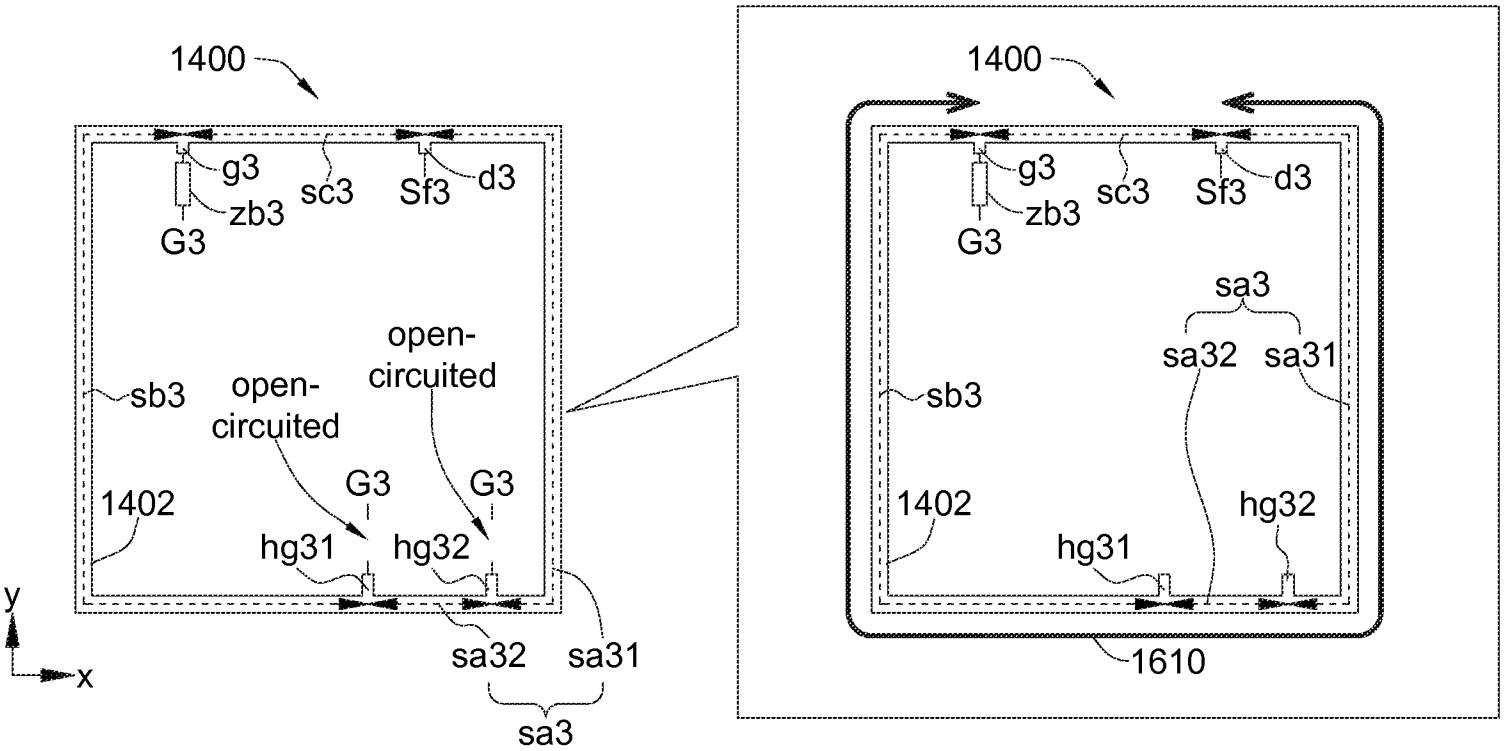
FIG. 16*a* to FIG. 16*c* illustrate operations of the antenna structure shown in FIG. 14.
Figure 16B:
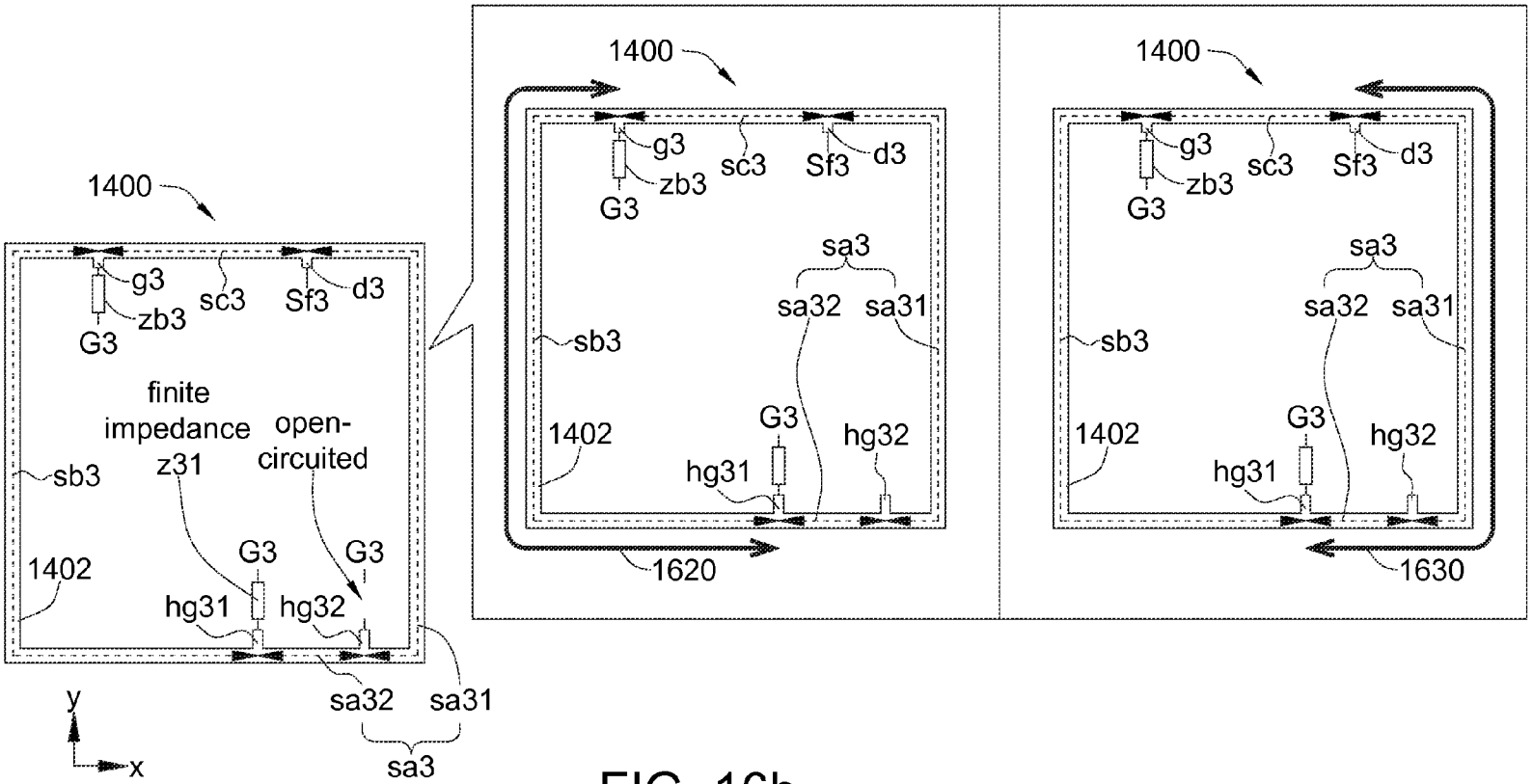
Figure 16C:
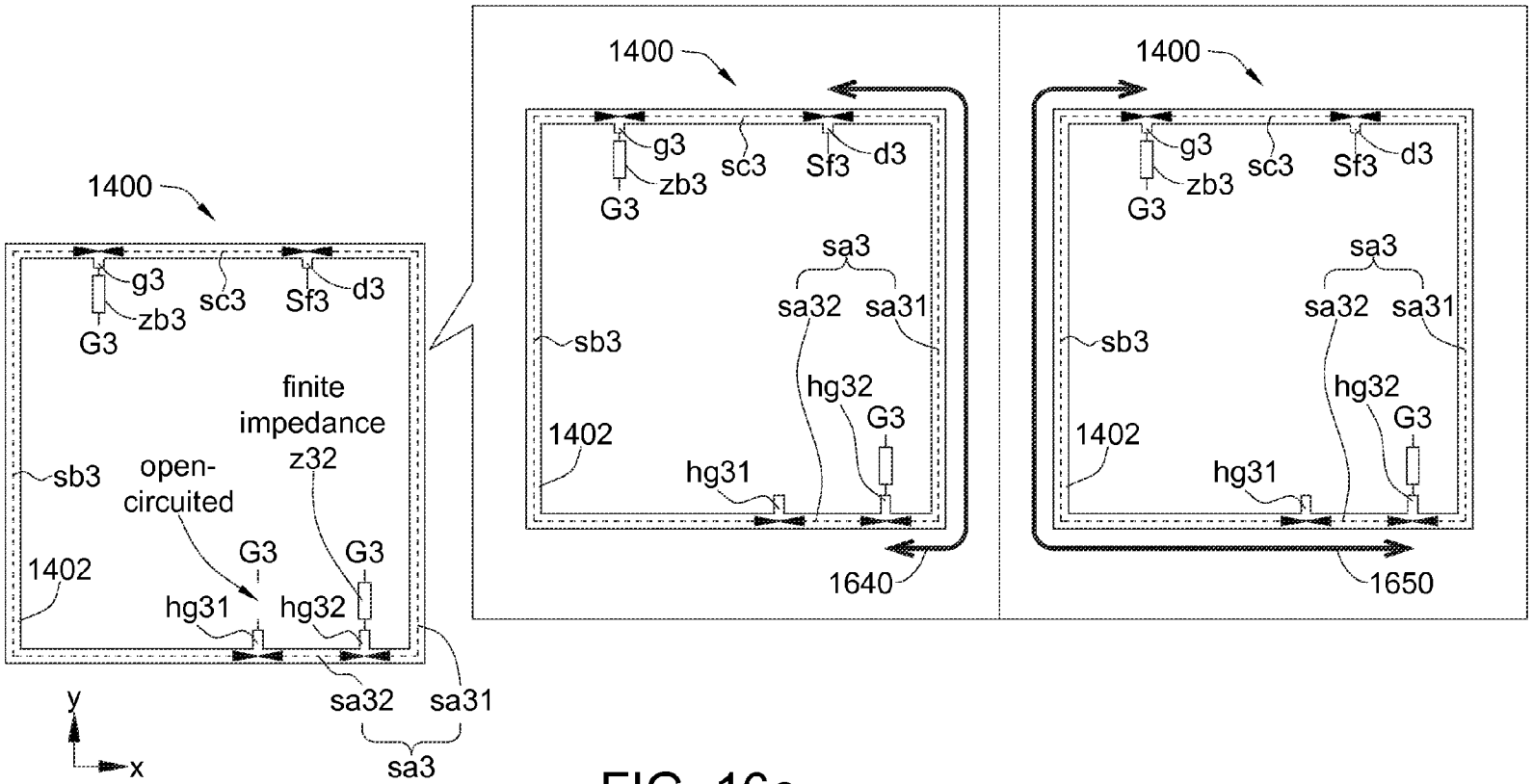

Please refer to FIG. 14, FIG. 15 and FIG. 16*a* to FIG. 16*c*; FIG. 14 illustrates an antenna structure 1400 according to an implementation of the disclosure, FIG. 15 illustrates electrical arrangement of the antenna structure 1400, and FIG. 16*a* to FIG. 16*c* illustrate operations of the antenna structure 1400. The antenna structure 1400 may be implemented by a conductive (e.g., metal) loop 1402, wherein the loop 1402 may be a closed ring surrounding an opening 1404 (FIG. 14) containing a ground plane G3, and may be a periphery of a metallic case of an electronic product (not shown).

The antenna structure 1400 may include conductive sections sa3 (head section), sb3 (intermediate section) and sc3 (tail section) as three non-overlapping portions of the loop 1402, along with terminals d3 (feed terminal), hg31 (intermediate grounding terminal), hg32 (second intermediate grounding terminal), and g3 (tail grounding terminal). Along the loop 1402, the conductive section sa3 may extend from the terminals d3 to hg31, the conductive section sb3 may extend from the terminals hg31 to g3, and the conductive section sc3 may extend from the terminals g3 to d3. The conductive section sa3 may include a section sb31 (first front section) and a section sa32 (second front section); along the loop 1402, the conductive section sa31 may extend from the terminals d3 to hg32, and the conductive section sa32 may extend from the terminals hg32 to hg31. The terminal d3 may be arranged to connect a feed signal Sf3. The terminal g3 may be arranged to connect the ground plane G3 via an impedance (tail impedance) zb3.

The antenna structure may operate in three operation modes respectively shown in FIG. 16*a* to FIG. 16*c*. The terminal hg31 may be responsible for conducting to the ground plane G3 via an impedance z31 (intermediate impedance, FIG. 16*b*) during a second operation mode shown in FIG. 16*b*, and ceasing conducting via the impedance z31 during a first operation mode shown in FIG. 16*a* and a third operation mode shown in FIG. 16*c*. For example, the terminal hg31 may maintain open-circuited during the first and third operation modes.

The terminal hg32 may be responsible for conducting to the ground plane G3 via an impedance z32 (second intermediate impedance, FIG. 16*c*) during the third operation mode shown in FIG. 16*c*, and ceasing conducting via the impedance z32 during the first operation mode and the second operation respectively shown in FIG. 16*a* and FIG. 16*b*. For example, the terminal hg32 may maintain open-circuited during the first and second operation modes.

As shown in FIG. 15, the terminal hg31 may connect to a switching circuit za31, and the terminal hg32 may connect to another switching circuit za32. The architecture of the switching circuit za31 may be similar to that shown in FIG. 3*a* or FIG. 3*b*; during the second operation mode, the switching circuit za31 may provide the finite impedance z31 between the ground plane G3 and the terminal hg31; on the other hand, during the first and third operation modes, the switching circuit za31 may provide a different impedance, e.g., an excessively large impedance, between the ground plane G3 and the terminal hg31, so the terminal hg31 may be (almost) open-circuited.

The architecture of the switching circuit za32 may also be similar to that shown in FIG. 3*a* or FIG. 3*b*; during the third operation mode, the switching circuit za32 may provide the finite impedance z32 between the ground plane G3 and the terminal hg32; on the other hand, during the first and second operation modes, the switching circuit za32 may provide a different impedance, e.g., an excessively large impedance, between the ground plane G3 and the terminal hg32, so the terminal hg32 may be (almost) open-circuited.

As shown in FIG. 16*a*, in the first operation mode, the terminals hg31 and hg32 may be open-circuited without being grounded to the ground plane G3, so the antenna structure 1400 may rely on the conductive sections sa3 and sb3 to jointly form a conductive path 1610 between the terminals d3 and the g3 for distribution of current, and jointly support a first electromagnetic resonance. The first electromagnetic resonance may be a half-wave resonance, which may have two anti-nodes respectively at the terminals d3 and g3, and only have a single null halfway between the terminals d3 and g3 along the conductive path 1610.

As shown in FIG. 16*b*, during the second operation mode, the terminal hg32 may be open-circuited without being grounded to the ground plane G3, so the sections sb3 alone may form a conductive path 1620 between the grounded terminals hg31 and g3 to support a second electromagnetic resonance, and the sections sa3 alone may form a conductive path 1630 between the feed terminal d3 and the grounded terminal hg31 to support a third electromagnetic resonance. The second electromagnetic resonance along the conductive path 1620 may be a half-wave resonance, which may have two anti-nodes respectively at the terminals hg31 and g3, and only have a single null halfway along the conductive path 1620 between the terminals hg31 and g3. The third electromagnetic resonance along the conductive path 1630 may also be a half-wave resonance, which may have two anti-nodes respectively at the terminals hg31 and d3, and only have a single null halfway between the terminals hg31 and d3 along the conductive path 1630.

As shown in FIG. 16*c*, in the third operation mode, the terminal hg31 may be open-circuited without being grounded to the ground plane G3, so the conductive sections sa31 may alone form a conductive path 1640 between the feed terminal d3 and the grounded terminal hg32 to support a fourth electromagnetic resonance, and the conductive sections sa32 and sb3 may jointly form a conductive path 1650 between the terminals hg32 and g3 to support a fifth electromagnetic resonance. The fourth electromagnetic resonance along the conductive path 1640 may be a half-wave resonance, which may have two anti-nodes respectively at the terminals d3 and hg32, and only have a single null halfway between the terminals d3 and hg32 along the conductive path 1640. The fifth electromagnetic resonance along the conductive path 1650 may also be a half-wave resonance, which may have two anti-nodes respectively at the terminals hg32 and g3, and only have a single null halfway between the terminals hg32 and g3 along the conductive path 1650.

Figure 17:
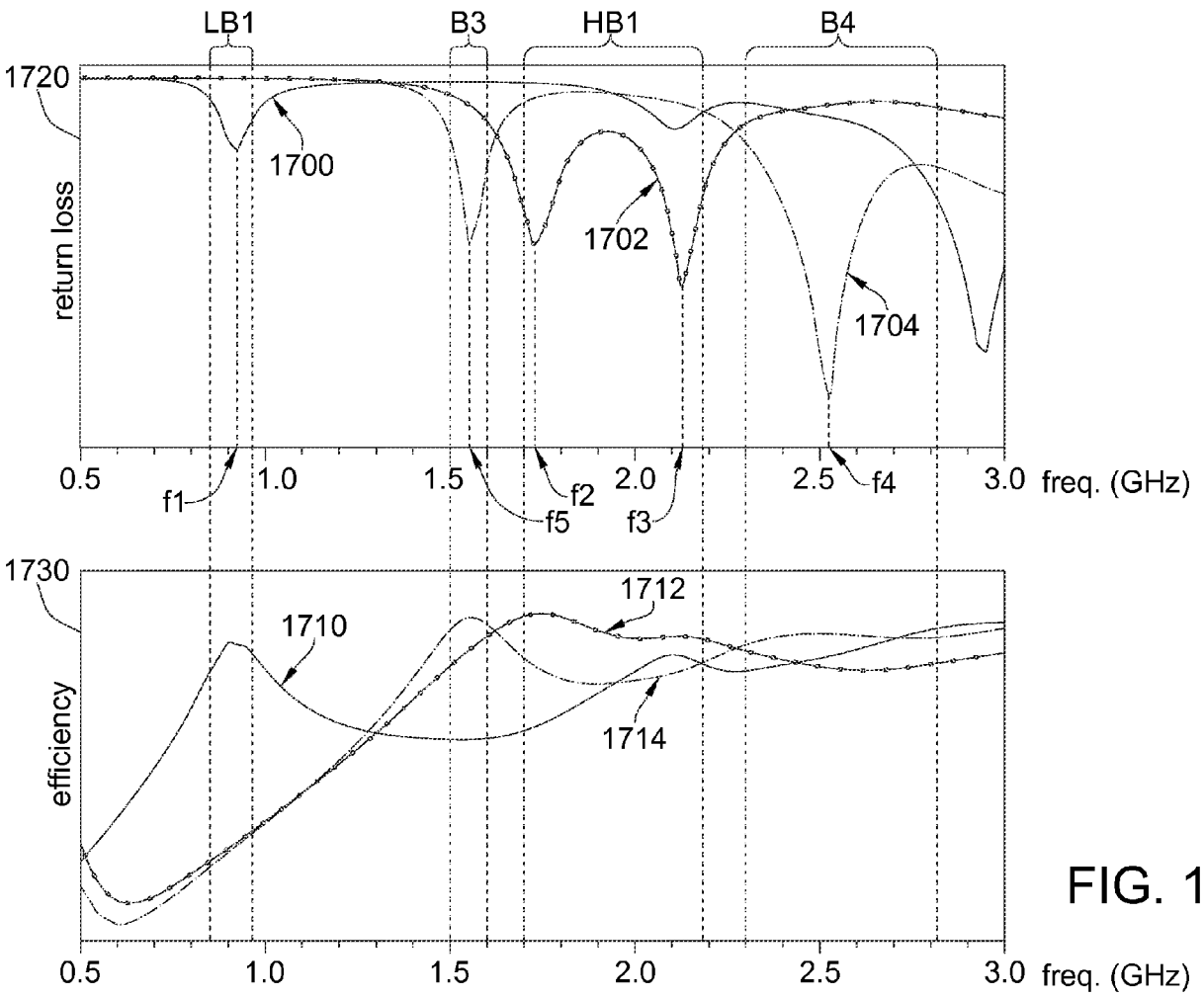
FIG. 17 illustrates exemplary performances/characteristics of the antenna structure shown in FIG. 14.

Along with FIG. 16*a* to FIG. 16*c*, please refer to FIG. 17 illustrating exemplary performances and/or characteristics of the antenna structure 1400 by frequency dependency of return loss and efficiency respectively shown in plots 1720 and 1730. The transverse axis of the plots 1720 and 1730 is frequency (in GHz), the longitudinal axis of the plot 1720 is magnitude of return loss (in dB), and the longitudinal axis of the plot 1730 is magnitude of efficiency.

The plot 1720 includes curves 1700, 1702 and 1704 demonstrate frequency dependency of return loss respectively in the first, second and third operation modes; the plot 1730 includes curves 1710, 1712 and 1714 demonstrate frequency dependency of antenna efficiency respectively in the first, second and third operation modes. As shown by the curve 1700 of the first operation mode, the first electromagnetic resonance along the longest conductive path 1610 (FIG. 16*a*) may introduce a low-frequency notch at frequency f1, so as to support wireless signaling at a band LB1. As shown by the curve 1702 of the second operation mode, the second and third electromagnetic resonances along the conductive paths 1620 and 1630 (FIG. 16*b*) may respectively causes notches at frequencies f2 and f3 to form two bands which may therefore jointly support wireless signaling at a band HB1. Also, as shown by the curve 1704 of the third operation mode, the fourth and fifth electromagnetic resonances along the conductive paths 1640 and 1650 (FIG. 16*c*) may respectively causes notches at frequencies f4 and f5, and accordingly support wireless signaling at bands B4 and B3. Because the conductive path 1610 (FIG. 16*a*) may be longer than either one of the conductive paths 1620 and 1630 (FIG. 16*b*), frequency of the band HB1 may be higher than frequency of the band LB1. Similarly, because the conductive path 1650 (FIG. 16*c*) may be shorter than the conductive path 1610 but longer than either of the conductive paths 1620 and 1630, frequency of the band B3 may be between the frequency of the band LB1 and frequency of the band HB1; and, since the conductive path 1640 (FIG. 16*c*) may be shorter than any one of the conductive paths 1620 and 1630, frequency of the band B4 may be higher than frequency of the band HB1.

A frequency difference between the frequencies f2 and f3 may relate to a length difference between lengths of the conductive paths 1620 and 1630 (FIG. 16*b*). A frequency difference between the frequencies f4 and f5 may relate to a length difference between lengths of the conductive paths 1640 and 1650 (FIG. 16*c*). In an implementation, the terminal hg31 may locate close to a middle point (not shown) of the conductive path 1610 (FIG. 16*a*) by a shorter geometric offset along the conductive path 1610, while the terminal hg32 may locate close to the middle point of the conductive path 1610 (FIG. 16*a*) by a longer geometric offset; accordingly, the length difference between the conductive paths 1640 and 1650 may be greater than that between the conductive paths 1620 and 1630, so the frequency difference between the frequencies f4 and f5 may be greater than that between the frequencies f2 and f3, and the frequencies f2 and f3 may fall inside a range bounded by the frequencies f4 and f5.

As shown in the example of FIG. 17, by properly placing the terminals d3, hg31, hg32 and g3, the band LB1 may cover GSM-900 around 900 MHz, and the band HB1 may cover GSM-1800 (DCS), GSM-1900 (PCS) and/or GSM band 1 (for WCDMA) around 1800 MHz and 1900 MHz. The band B3 may be compliant to GPS, and the band B4 may cover 2.3 GHz to 2.7 GHz for RF signaling of higher frequencies.

As demonstrated by the antenna structure 1400, by placing and controlling open-circuit status of one or more intermediate grounding terminals (e.g., hg31 and hg32) between the feed terminal d3 and the grounded terminal g3 along the conductive path 1610 (FIG. 16*a*), the conductive path 1610 may be electromagnetically divided in different ways (e.g., FIG. 16*a* to FIG. 16*c*), and therefore be reused to support multiple bands (e.g., the bands LB1, HB1, B3 and B4).

In an implementation, the impedance z31 (FIG. 16*b*) may be capacitive, the impedance z32 (FIG. 16*c*) may be capacitive, and the impedance zb3 may be inductive. Similar to the discussion about FIG. 6 and FIG. 7, adjusting value(s) of the impedance z31, the impedance z32 and/or the impedance zb3 may provide further flexibility to tune performances and/or characteristics of the antenna structure 1400.

Figure 18:
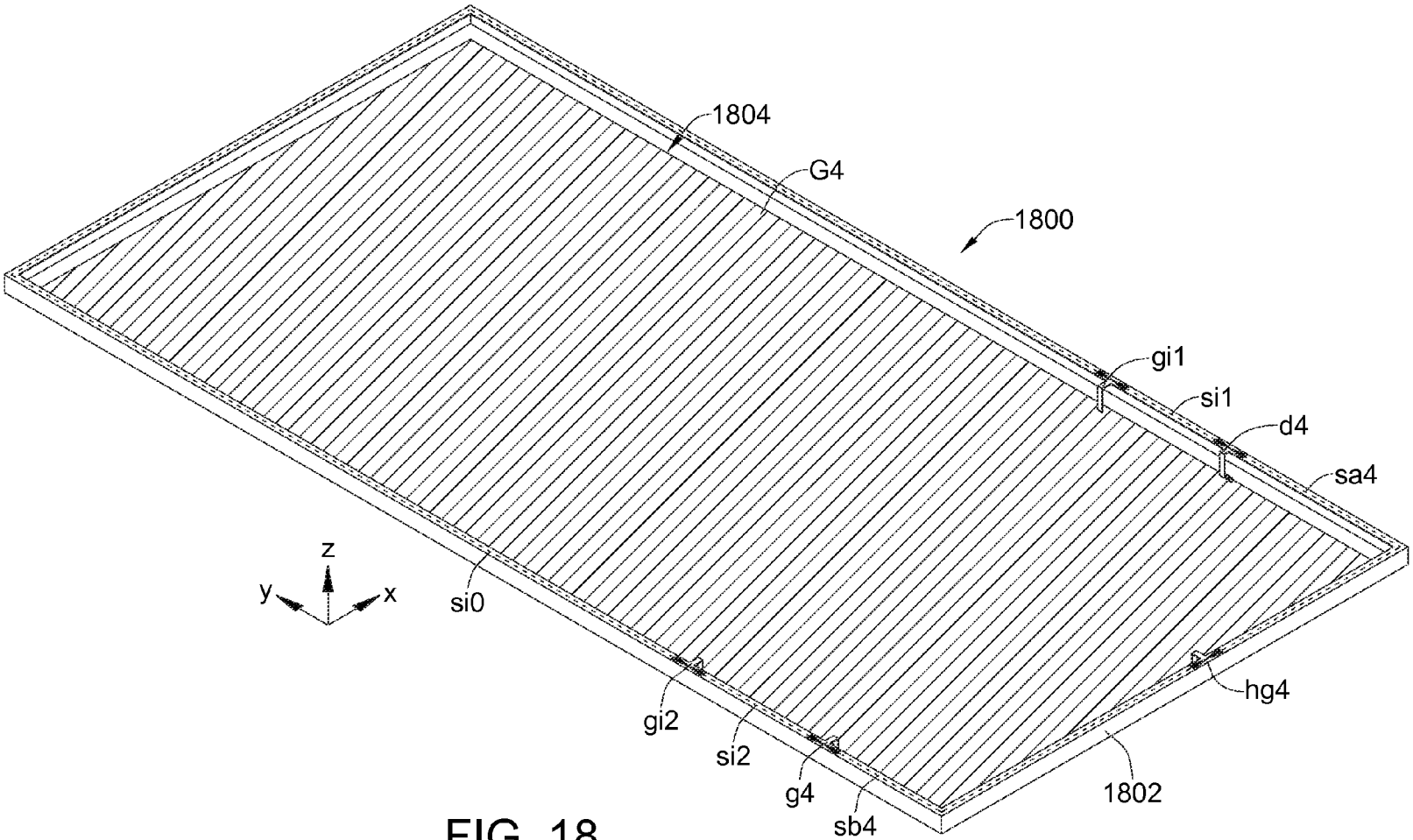
FIG. 18 illustrates an antenna structure according to an implementation of the disclosure.
Figure 19:
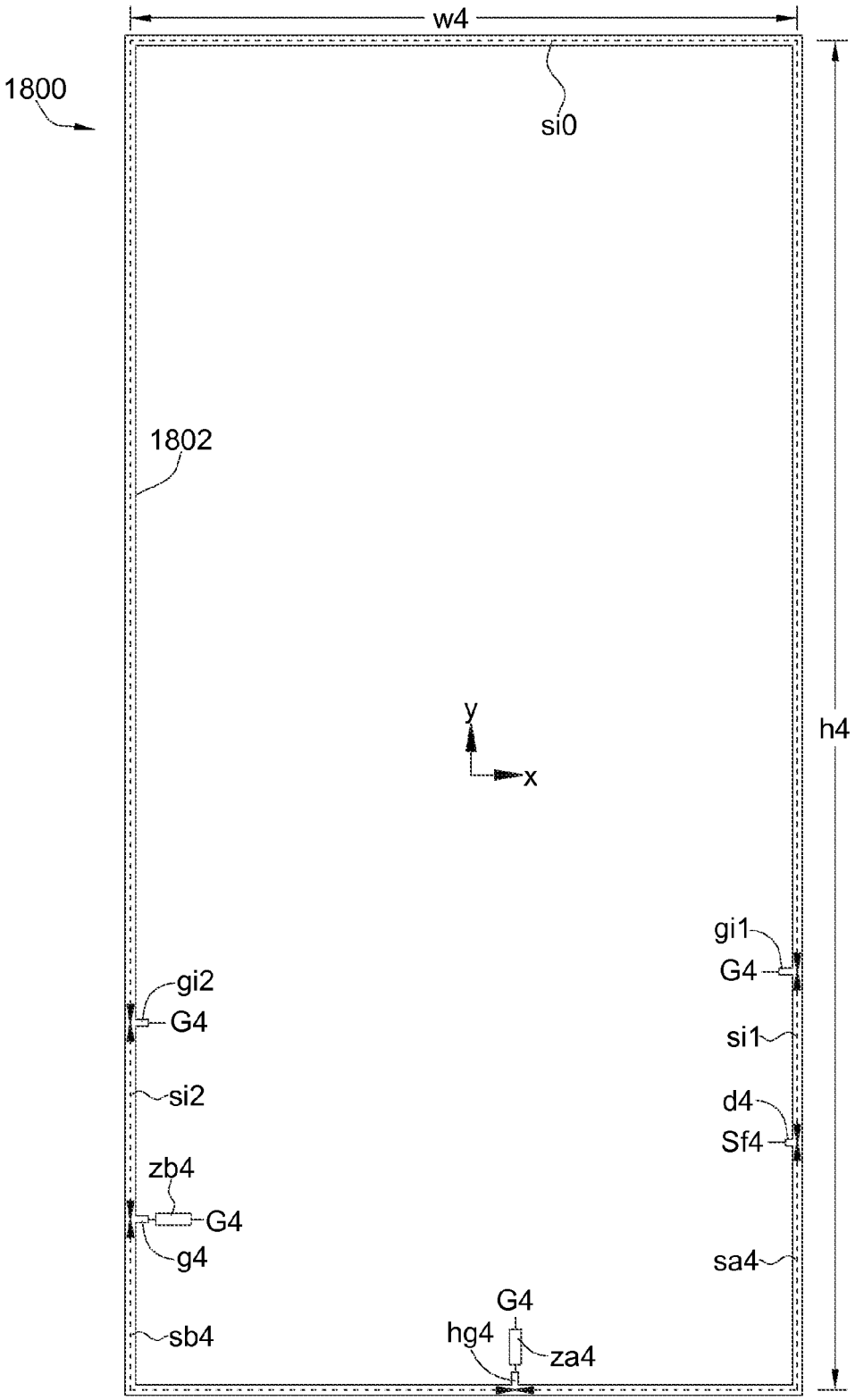
FIG. 19 illustrates electrical arrangement of the antenna structure of the antenna shown in FIG. 18.
Figure 20A:
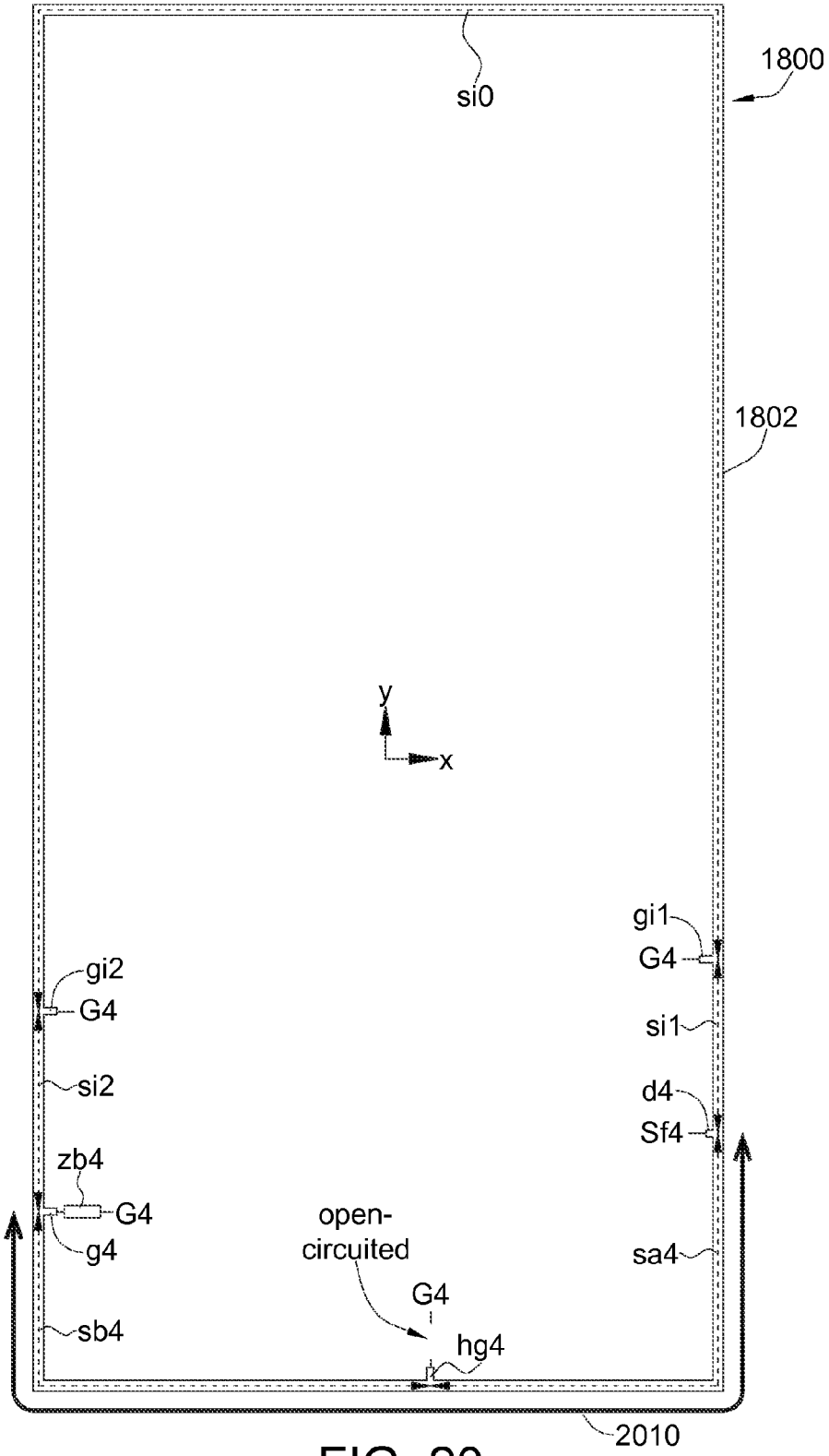
FIG. 20*a* to FIG. 20*c* illustrate operations of the antenna structure shown in FIG. 18.
Figure 20B:
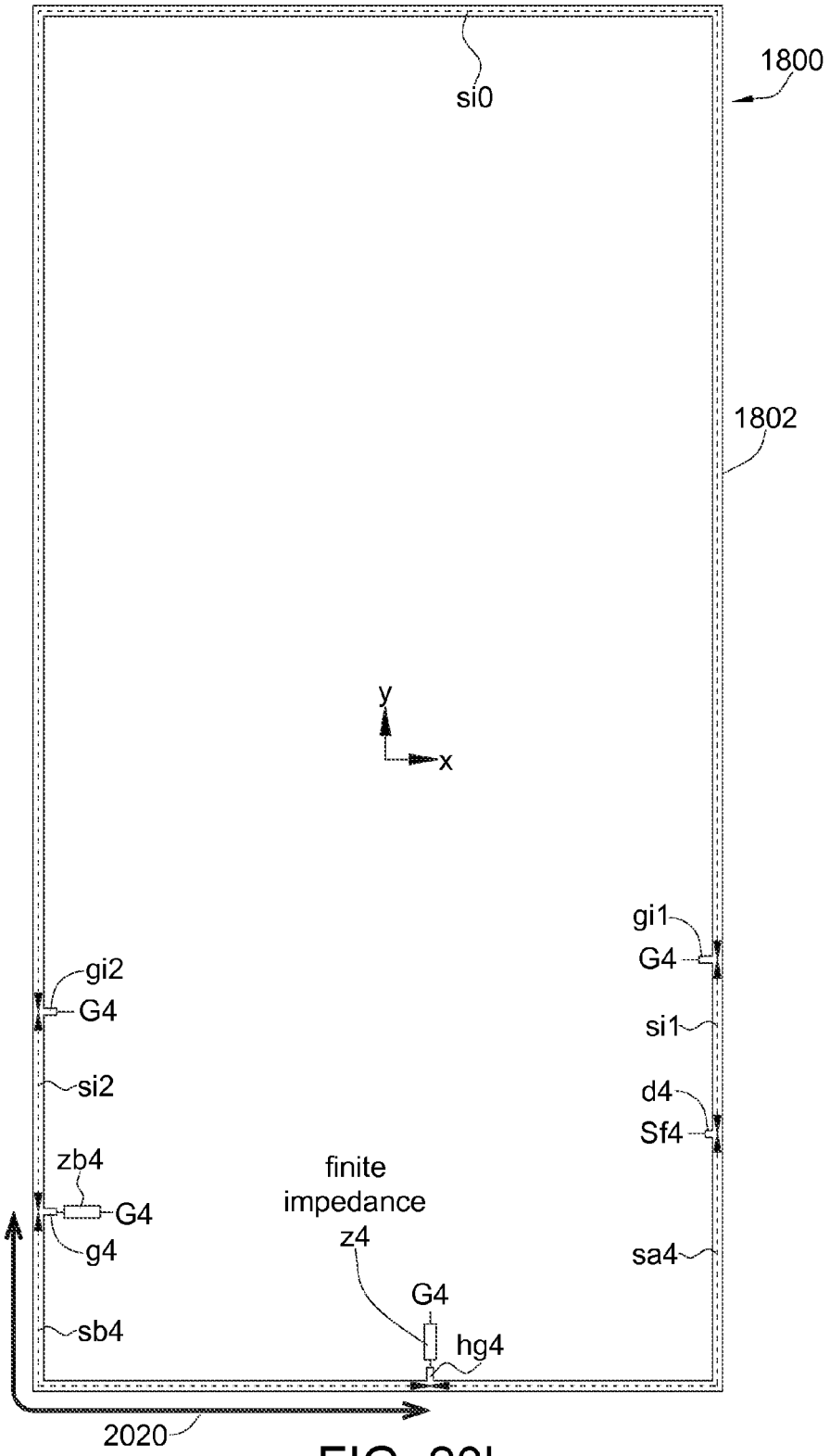
Figure 20C:
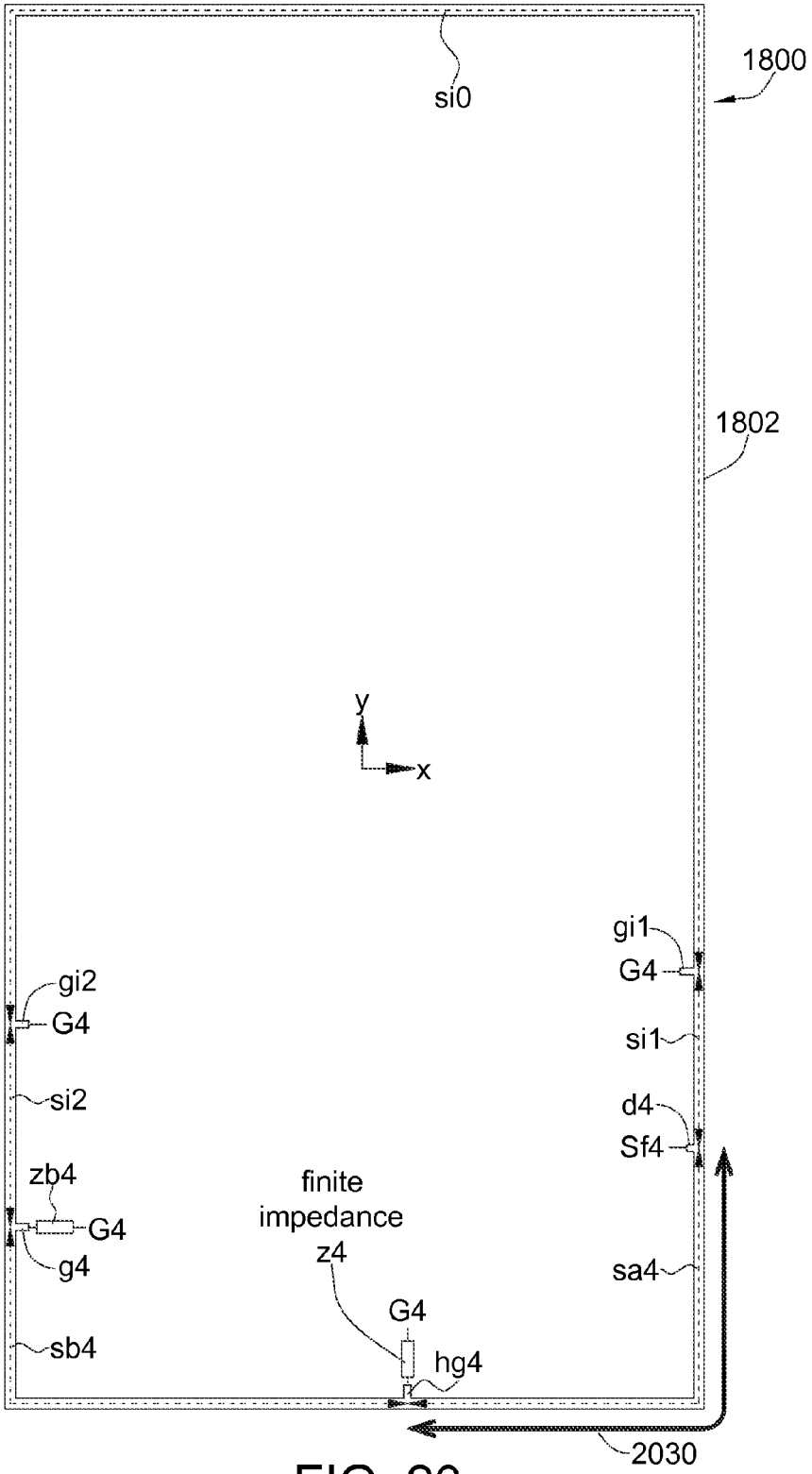
Figure 21:
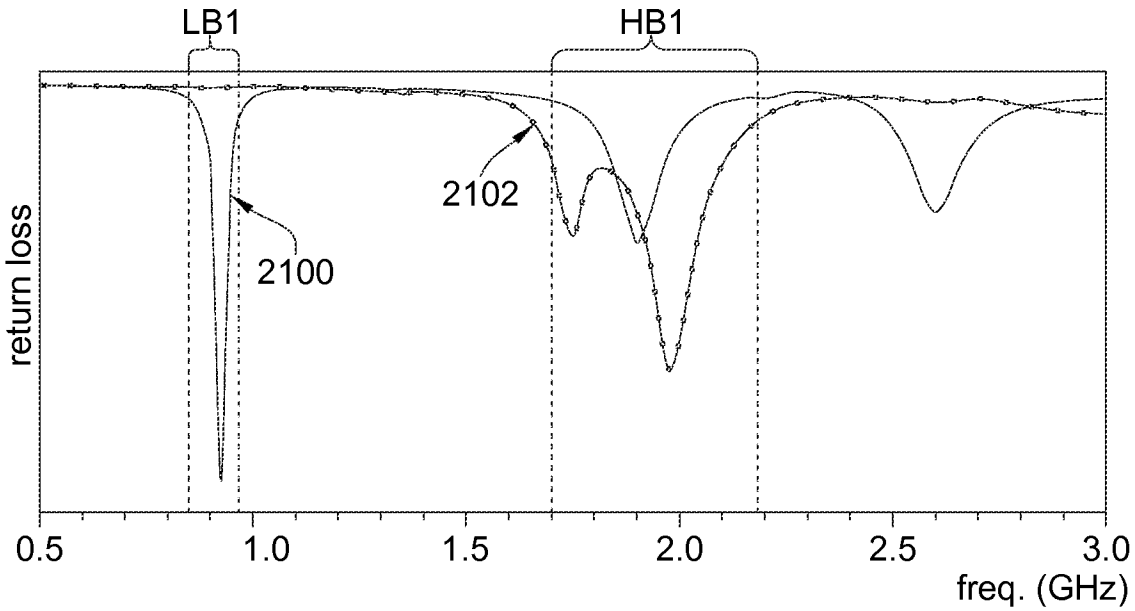
FIG. 21 illustrates exemplary performances/characteristics of the antenna structure shown in FIG. 18.

Please refer to FIG. 18, FIG. 19, FIG. 20*a* to FIG. 20*c* and FIG. 21, wherein FIG. 18 illustrates an antenna structure 1800 according to an implementation of the disclosure, FIG. 19 illustrates electrical arrangement of the antenna structure 1800, FIG. 20*a* to FIG. 20*c* illustrate operations of the antenna structure 1800, and FIG. 21 demonstrates exemplary performances and/or characteristics of the antenna structure 1800. The antenna structure 1800 may be implemented by a conductive closed loop 1802; for instance, the loop 1802 may be a periphery of a metallic case of an electronic product (not shown), e.g., a smart phone with mechanism structure larger than a smart watch. For example, a width w4 and a height h4 of the loop 1802 (FIG. 19) may approximately be 78 mm and 158 mm, respectively. Although the loop 1802 may be larger than the loop 102 and 1002 respectively shown in FIG. 4 and FIG. 13, the antenna structure 1800 may still be embedded along the loop 1802 and remain to satisfy similar demands of antenna design.

The loop 1802 may surround an opening 1804 (FIG. 18) providing a vacancy to contain a ground plane G4. The antenna structure 1800 may include terminals d4, hg4, g4, gi1 and gi2, along with sections sa4, sb4, si0, si1 and si2 as different portions of the loop 1802. As shown in FIG. 19 and FIG. 20*a* to FIG. 20*c*, the terminal d4 (feed terminal) may be responsible for connecting a feed signal Sf4, the terminal g4 (tail grounding terminal) may be responsible for connecting the ground plane G4 via an impedance zb4 (tail impedance). The terminal hg4 (intermediate grounding terminal) may be responsible for conducting to the ground plane G4 via an impedance z4 (intermediate impedance) during a second operation mode shown in FIG. 20*b* and FIG. 20*c*, and not conducting to the ground plane G4 via the impedance z4 during a first operation mode shown in FIG. 20*a*.

For example, the terminal hg4 may connect a switching circuit za4 (FIG. 19), which may provide the impedance z4 between the terminal hg4 and the ground plane G4 during the second operation mode, and provide another impedance, e.g., an excessive impedance, in the first operation mode, so the terminal hg4 may be open-circuited during the first operation mode. The switch circuit za4 may be formed according to FIG. 3*a* or FIG. 3*b*. In an implementation, the impedance z4 may be capacitive, and the impedance zb4 may be inductive. As discussed in FIG. 6 and FIG. 7, adjusting value(s) of the impedance(s) zb4 and/or z4 may provide further flexibility to tune performances and/or characteristics of the antenna structure 1800.

The terminals gi1 and gi2 (isolation grounding terminals) may be responsible for connecting the ground plane G4. For example, the terminal gi1 may directly connect the ground plane G4 without interposed impedance (component(s)) between the terminal gi1 and the ground plane G4. Similarly, the terminal gi2 may directly connect the ground plane G4 without interposed impedance between the terminal gi2 and the ground plane G4.

The conductive section sa4 (the head section) may extend from the terminals d4 to hg4 along the loop 1802; the conductive section sb4 (intermediate section) may extend from the terminals hg4 to g4 along the loop 1802. The section sit (isolation section) may extend from the terminals d4 to gi1 along the loop 1802, without overlapping the conductive section sa1; the section si2 (another isolation section) may extend from the terminals g4 to gi2 along the loop 1802, without overlapping the conductive section sb4. The section si0 may extend between the terminals gi1 and gi2.

As shown in FIG. 20*a*, during the first operation mode, because the terminal hg4 may not be grounded, the conductive sections sa4 and sb4 may jointly provide a conductive path 2010 between the terminal d4 and grounded terminal g4 to support a first electromagnetic resonance. As shown in FIG. 20*b* and FIG. 20*c*, during the second operation mode, the terminal hg4 may be grounded via the finite impedance z4, so the conductive section sb4 between the terminals hg4 and g4 may individually provide a conductive path 2020 (FIG. 20*b*) to support a second electromagnetic resonance, and the conductive section sa4 between the terminals d4 and hg4 may alone provide another conductive path 2030 (FIG. 20*c*) to support a third electromagnetic resonance. The first electromagnetic resonance may be a half-wave electromagnetic resonance with two anti-nodes at the terminals d4 and g4, as well as a single null approximately at middle point of the path 2010. The second electromagnetic resonance may be a half-wave electromagnetic resonance with two anti-nodes at the terminals hg4 and g4, as well as a single null approximately at middle point of the path 2020. The third electromagnetic resonance may be a half-wave electromagnetic resonance with two anti-nodes at the terminals hg4 and d4, as well as a single null at middle point of the path 2030.

By arranging geometric location of the terminals d4, hg4 and g4, a length of the conductive section sb4 (i.e., length of the path 2020 in FIG. 20*b*) may be set longer than a sum of a length of the section si1 and a length of the conductive section sa4 (i.e., length of the path 2030 in FIG. 20*c*). With such length relation, electromagnetic resonance of the section si1 may be overpowered by electromagnetic resonances of the paths 2010, 2020 and 2030, so electromagnetic resonance of the section si1 may not interfere wireless signaling utilizing electromagnetic resonances of the paths 2010, 2020 and 2030.

To support a band LB1 covering GSM-900 around 900 MHz and a band HB1 covering GSM-1800 (DCS), GSM-1900 (PCS) and/or GSM band 1 (for WCDMA) around 1800 MHz and/or 1900 MHz as labeled in FIG. 21, length of the conductive section sa4 (the path 2030 in FIG. 20*c*) may be set to approximate 65 mm, and length of the conductive section sb4 (the path 2020 in FIG. 20*c*) may be set to approximate 62 mm. With such length setting, frequency dependency of return loss during the first operation mode may be described by a curve 2100 in FIG. 21, and frequency dependency of return loss during the second operation mode may be described by a curve 2102. As demonstrated by the curves 2100 and 2102, the antenna structure 1800 may successfully achieve desired bands LB1 and HB1 respectively during the first operation mode (FIG. 20*a*) and the second operation mode (FIG. 20*b* and FIG. 20*c*).

Figure 22:
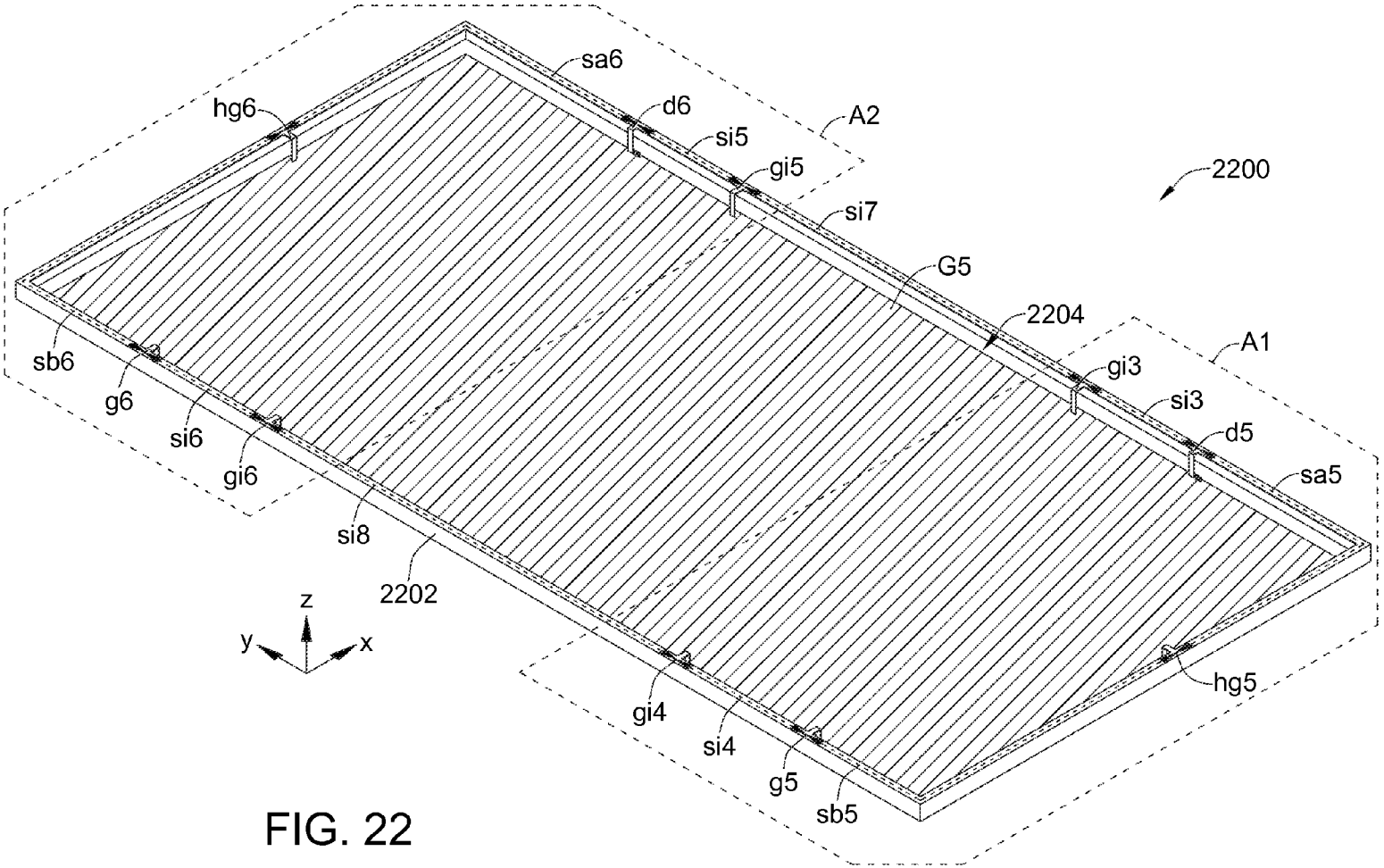
FIG. 22 illustrates an antenna structure according to an implementation of the disclosure.
Figure 23:
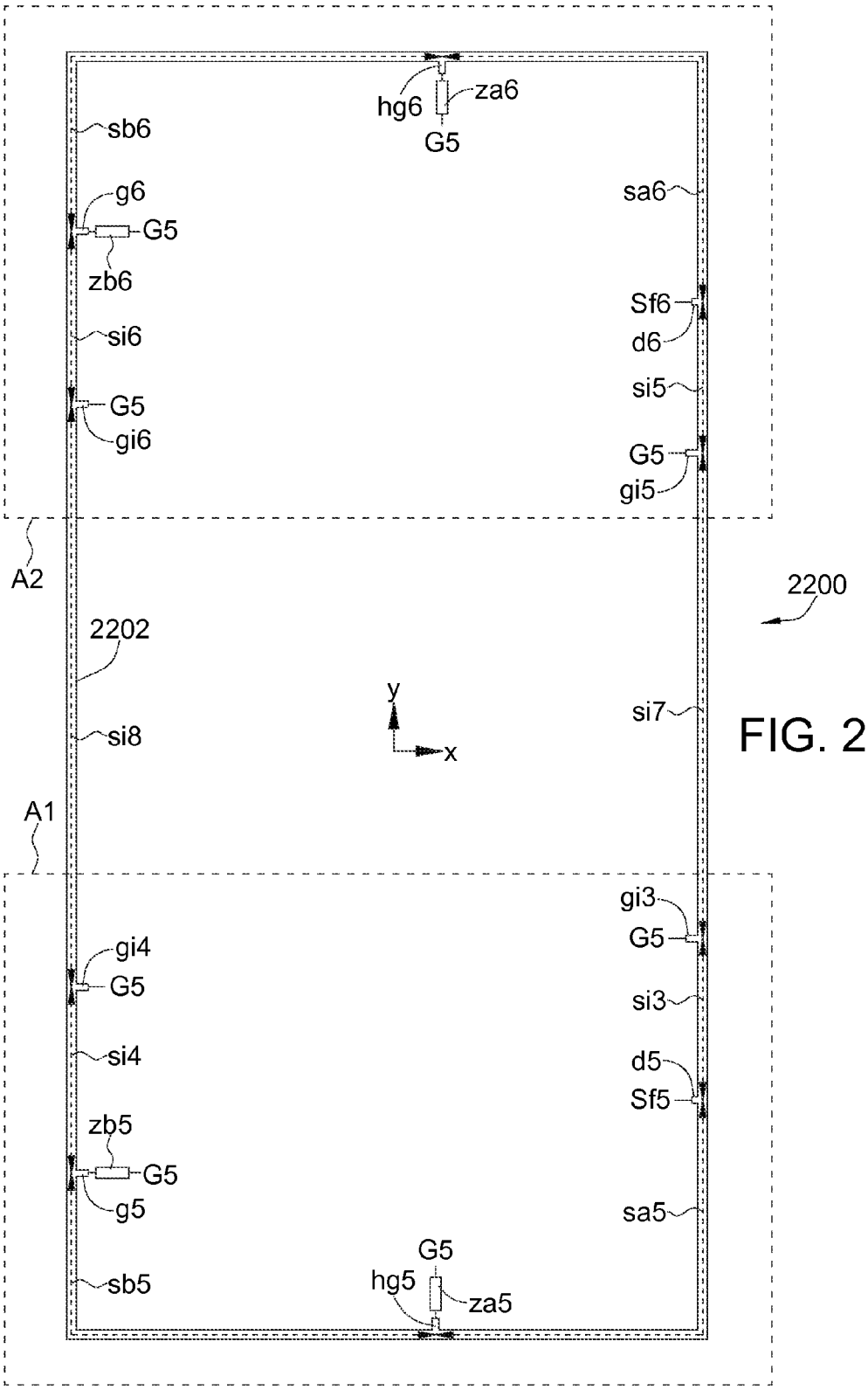
FIG. 23 illustrates electrical arrangement of the antenna structure shown in FIG. 22.
Figure 24A:
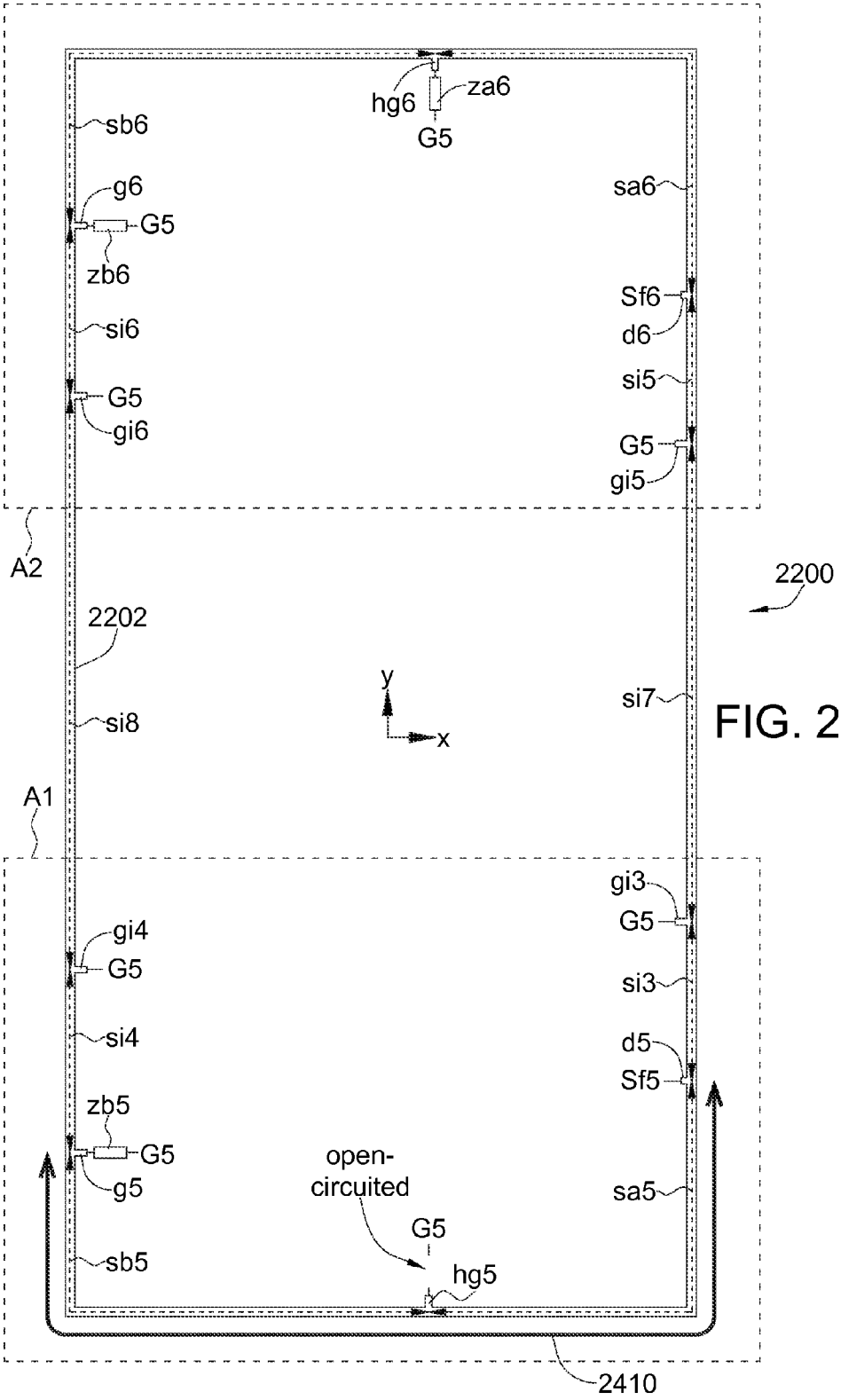
FIG. 24*a* to FIG. 24*c* and FIG. 25*a* to FIG. 25*c* illustrate operations of the antenna structure shown in FIG. 22.
Figure 24B:
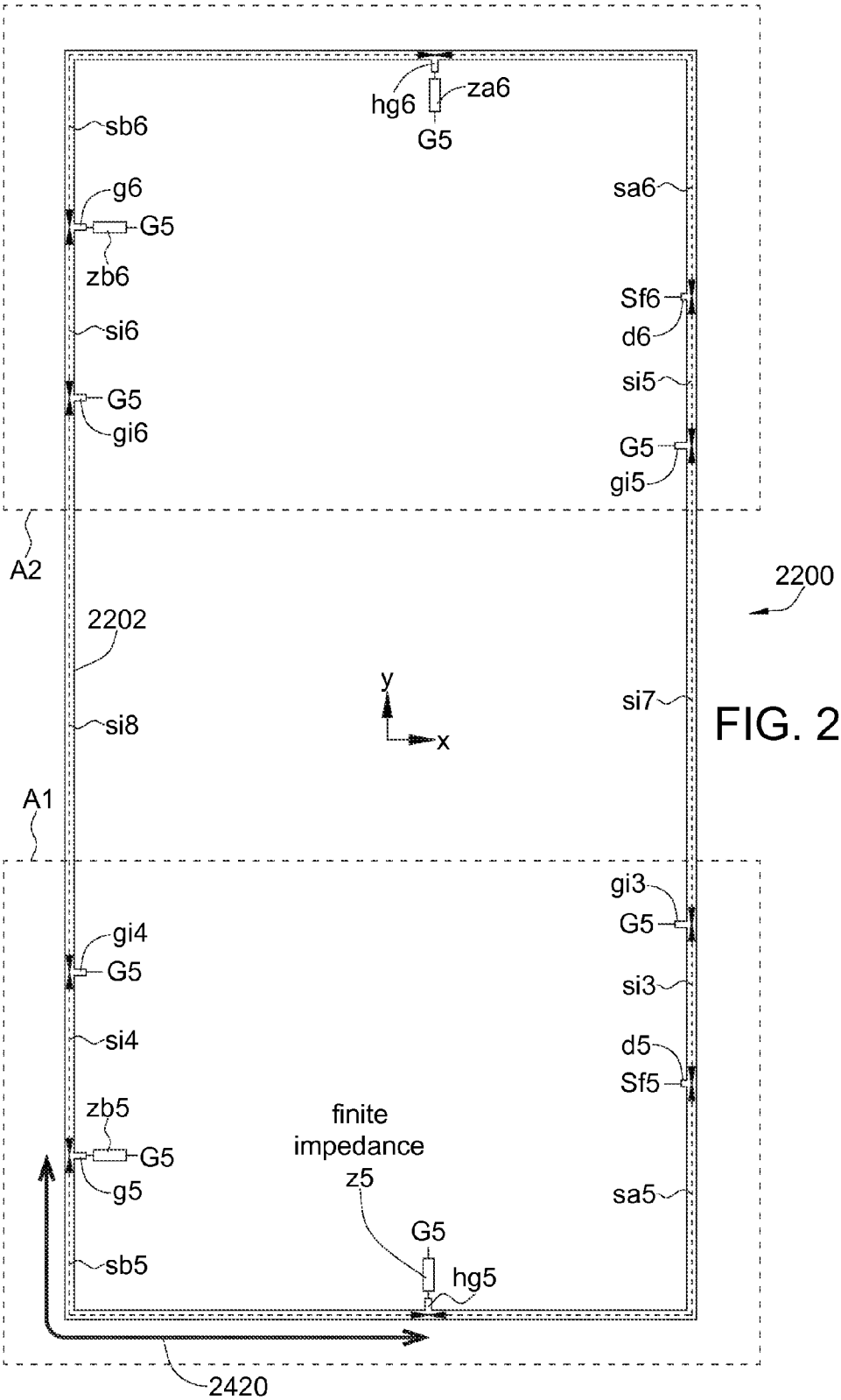
Figure 24C:
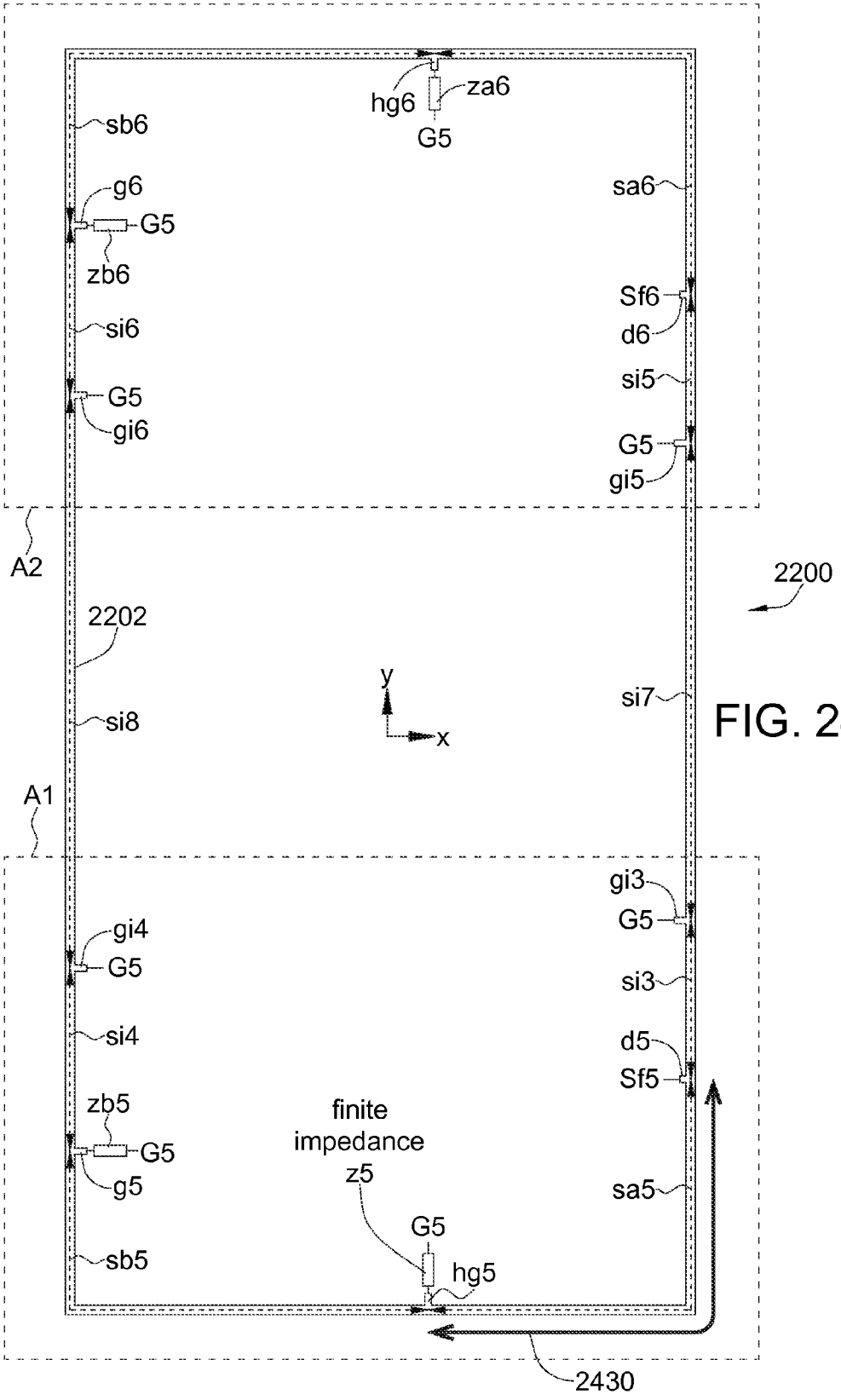
Figure 25A:
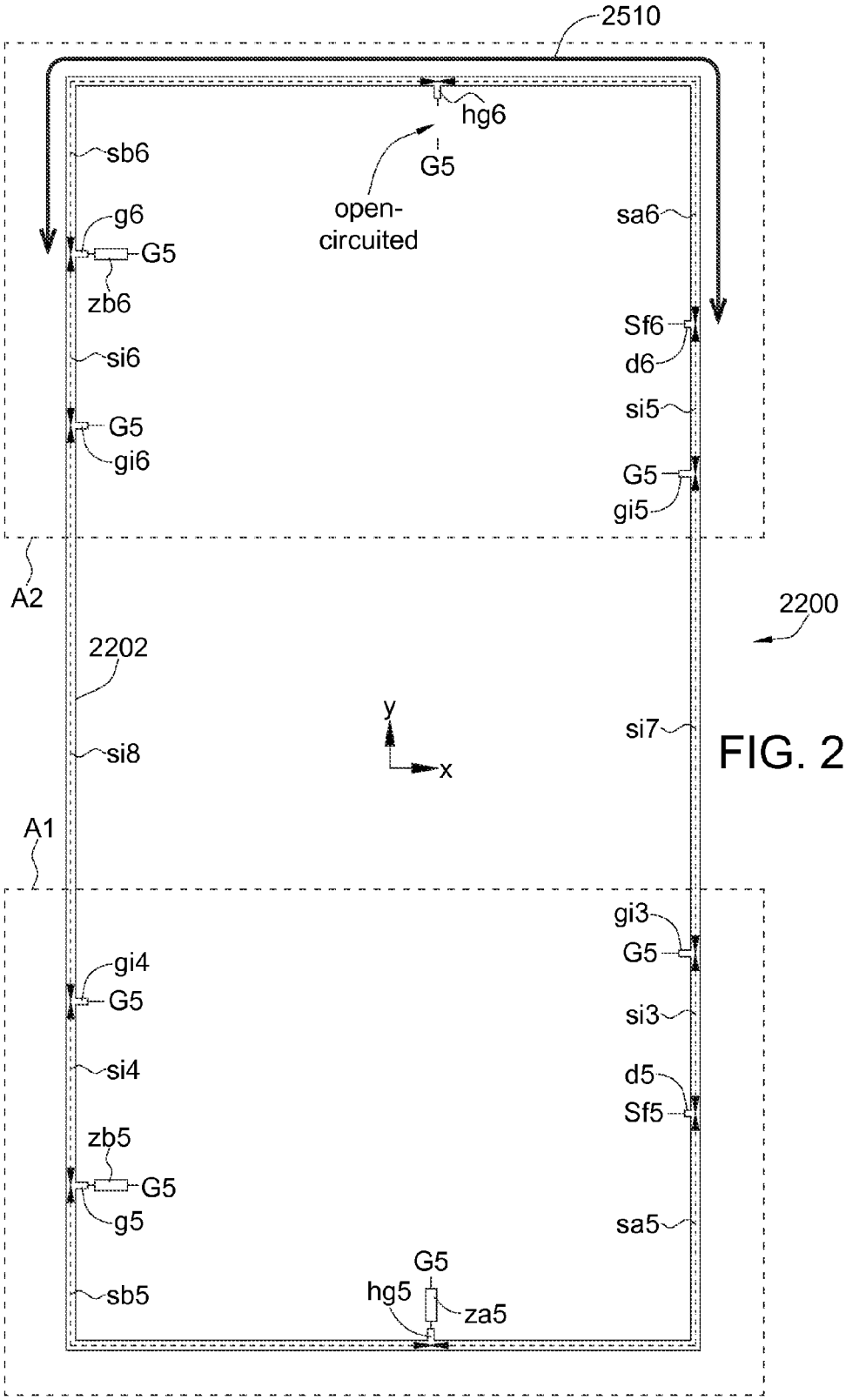
Figure 25B:
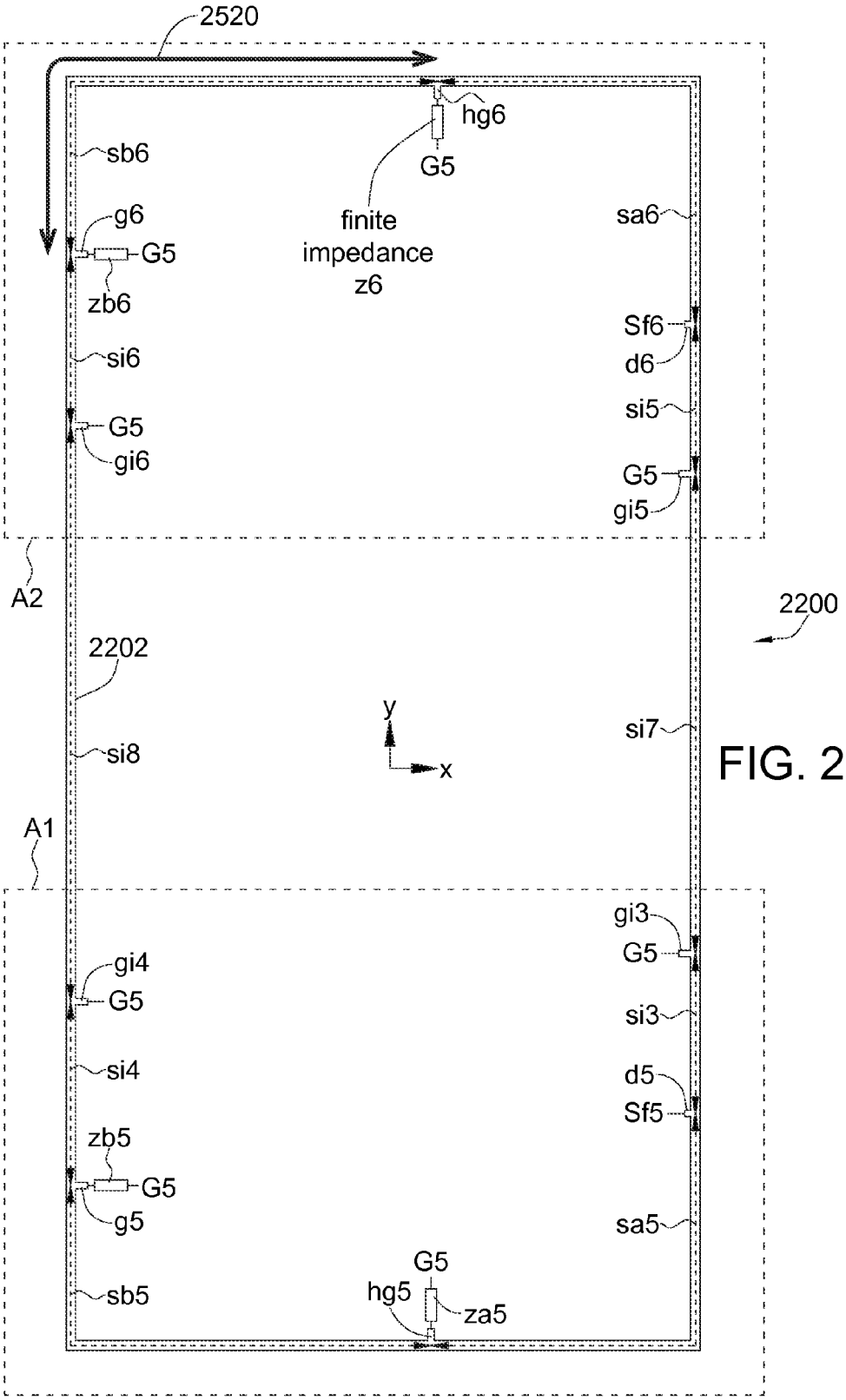
Figure 25C:
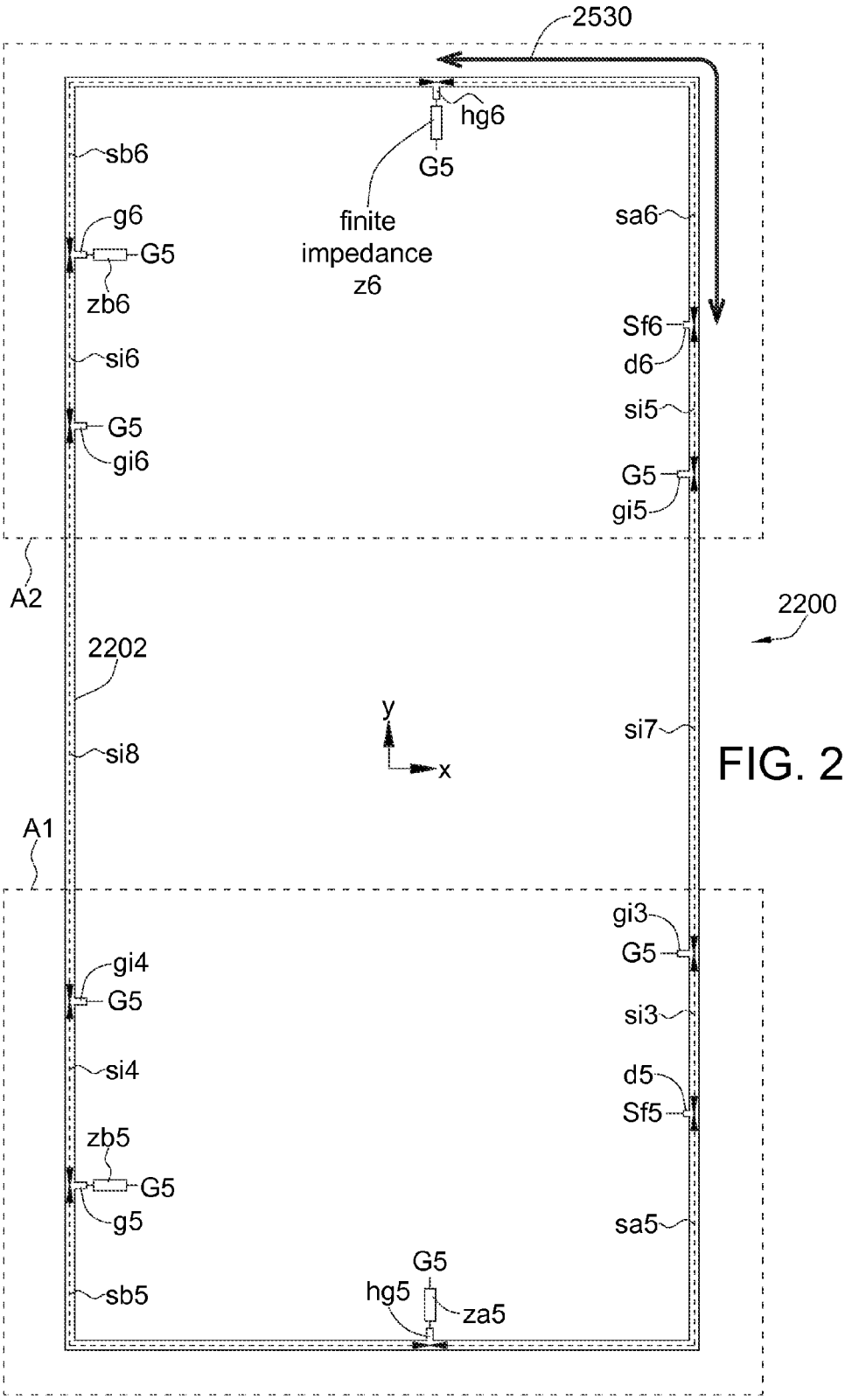
Figure 26:
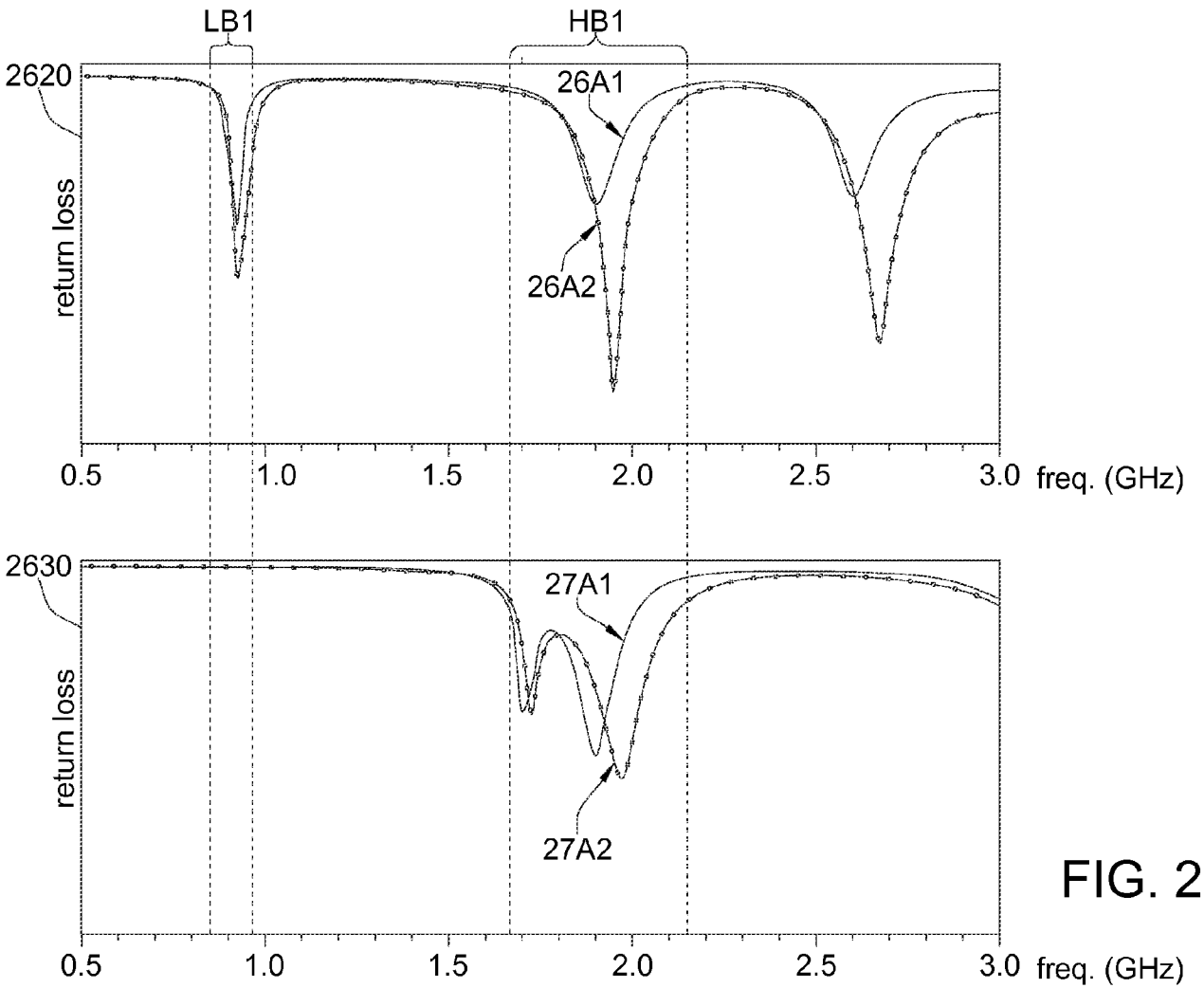
FIG. 26 illustrates exemplary performances/characteristics of the antenna structure shown in FIG. 22.

While the terminals d4, hg4 and g4 and the conductive sections sa4 and sb4 may form a multi-band antenna, the directly grounded terminals gi1 and gi2 may facilitate isolation between the antenna and the section si0. The section si0 may therefore be leveraged to implement another antenna. For an antenna structure implementing multiple antennas along a single loop, please refer to FIG. 22, FIG. 23, FIG. 24*a* to FIG. 24*c*, FIG. 25*a* to FIG. 25*c*, and FIG. 26. FIG. 22 illustrates an antenna structure 2200 according to an implementation of the disclosure, which may include two antennas A1 and A2 along a same loop 2202. FIG. 23 illustrates electrical arrangement of the antenna structure 2200. FIG. 24*a* to FIG. 24*c* illustrate operations of the antenna A1, and FIG. 25*a* to FIG. 25*c* illustrate operations of the antenna A2. FIG. 26 illustrates exemplary frequency dependency of return loss of the antennas A1 and A2.

The loop 2202 may be a periphery of a metallic case, and may surround an opening 2204 (FIG. 22) which may provide a vacancy to contain a ground plane G5. The antenna structure 2200 may include terminals d5, hg5, g5, gi3, gi4, d6, hg6, g6, gi5 and gi6, along with sections sa5, sb5, sa6, sb6, si3, si4, si5, si6, si7 and si8 which may be different portions of the loop 2202. The antenna A1 may be formed by the terminals d5, hg5, g5, gi3, gi4 and the sections sa5, sb5, si3 and si4. The antenna A2 may be formed by the terminals d6, hg6, g6, gi5, gi6 and the sections sa6, sb6, si5 and si6. Comparing to the antenna structure 1800 shown in FIG. 18 which includes a single antenna formed by the terminals d4, hg4, g4, gi1, gi2 and sections sa4, sb4, sit and si2, it is understood that another antenna may be implemented using the section si0 (FIG. 18) between the terminals gi1 and gi2 along the loop 1802, just as demonstrated by the antenna structure 2200 in FIG. 22. Similar to the single antenna of the antenna structure 1800, each of antennas A1 and A2 in the antenna structure 2200 may work in two operation modes.

In the antenna A1, the terminal d5 (feed terminal) may be responsible for connecting a feed signal Sf5, the terminal g5 (tail grounding terminal) may be responsible for connecting the ground plane G5 via an impedance zb5 (tail impedance). The terminal hg5 (intermediate grounding terminal) may be responsible for conducting to the ground plane G5 via an impedance z5 (intermediate impedance) during a second operation mode shown in FIG. 24*b* and FIG. 24*c*, and stopping conducting to the ground plane G5 via the impedance z5 during a first operation mode shown in FIG. 24*a*. For example, the terminal hg5 may connect a switching circuit za5 (FIG. 23), which may provide the impedance z5 between the terminal hg5 and the ground plane G5 during the second operation mode, and provide another impedance, e.g., an excessive impedance, in the first operation mode, so the terminal hg5 may be open-circuited during the first operation mode. The switch circuit za5 may be formed according to FIG. 3*a* or FIG. 3*b*. In an implementation, the impedance z5 may be capacitive, and the impedance zb5 may be inductive. As discussed in FIG. 6 and FIG. 7, adjusting value(s) of the impedance(s) zb5 and/or z5 may provide further flexibility to tune performances and/or characteristics of the antenna A1.

In the antenna A1, the terminals gi3 and gi4 (isolation grounding terminals) may be responsible for connecting the ground plane G5. For example, the terminal gi3 may directly connect the ground plane G5 without interposed impedance between the terminal gi3 and the ground plane G5. Similarly, the terminal gi4 may directly connect the ground plane G5 without interposed impedance between the terminal gi4 and the ground plane G5.

In the antenna A1, the conductive section sa5 (the head section) may extend from the terminals d5 to hg5 along the loop 2202; the conductive section sb5 (intermediate section) may extend from the terminals hg5 to g5 along the loop 2202. The section si3 (isolation section) may extend from the terminals d5 to gi3 along the loop 2202, the section si4 (another isolation section) may extend from the terminals g5 to gi4 along the loop 2202.

As shown in FIG. 24*a*, during the first operation mode, the conductive sections sa5 and sb5 may jointly provide a conductive path 2410 between the terminal d5 and grounded terminal g5 to support a first electromagnetic resonance. As shown in FIG. 24*b* and FIG. 24*c*, during the second operation mode, the section sb5 may individually provide a conductive path 2420 (FIG. 24*b*) to support a second electromagnetic resonance, and the section sa5 may alone provide another conductive path 2430 (FIG. 24*c*) to support a third electromagnetic resonance. The first electromagnetic resonance may be a half-wave electromagnetic resonance with two anti-nodes at the terminals d5 and g5, as well as a single null approximately at middle point of the path 2410. The second electromagnetic resonance may be a half-wave electromagnetic resonance with two anti-nodes at the terminals hg5 and g5, as well as a single null approximately at middle point of the path 2420. The third electromagnetic resonance may be a half-wave electromagnetic resonance with two anti-nodes at the terminals hg5 and d5, as well as a single null at middle point of the path 2430. In an implementation, length of the conductive section sb5 (path 2420) may be longer than a sum of length of the section si3 and length of the conductive section sa5 (path 2430), so as to suppress undesired electromagnetic resonance of the section si3.

While the sections si3, sa5, sb5, and si4 may collectively form the antenna A1, the rest portion of the loop 2202 may be divided by the terminals gi5, d6, hg6, g6, and gi6 to form the sections si7, si5, sa6, sb6, si6 and si8 for constructing the antenna A2. For the antenna A2, the terminal d6 (second feed terminal) may be responsible for connecting a feed signal Sf6. Although the terminal d6 of the antenna A2 may be conductively connected to the antenna A1 at the terminal gi3 by a first loop portion (additional section) extending from the terminals gi3, gi5 to d6 along the loop 2202, the terminals gi3 and gi5 on this first loop portion may effectively contribute to isolation between the antennas A1 and A2. The terminal d6 of the antenna A2 may also be conductively connected to the antenna A1 at the terminal gi4 by a second loop portion extending from the terminals gi4, gi6, g6, hg6 to d6; however, the terminals gi4 and gi6 on this second loop portion may effectively contribute to isolation between the antennas A1 and A2.

In the antenna A2, besides the terminal d6 for connecting the feed signal Sf6, the terminal g6 (tail grounding terminal) may be responsible for connecting the ground plane G5 via an impedance zb6 (tail impedance). The terminal hg6 (intermediate grounding terminal) may be responsible for conducting to the ground plane G5 via an impedance z6 (intermediate impedance) during a fourth operation mode shown in FIG. 25*b* and FIG. 25*c*, and stopping conducting to the ground plane G5 via the impedance z6 during a third operation mode shown in FIG. 25*a*. For example, the terminal hg6 may connect a switching circuit za6 (FIG. 23), which may provide the impedance z6 between the terminal hg6 and the ground plane G5 in the fourth operation mode, and provide another impedance, e.g., an excessive impedance, in the third operation mode, so the terminal hg6 may be open-circuited during the third operation mode. The switch circuit za6 may be formed according to FIG. 3*a* or FIG. 3*b*. In an implementation, the impedance z6 may be capacitive, and the impedance zb6 may be inductive. As discussed in FIG. 6 and FIG. 7, adjusting value(s) of the impedance(s) zb6 and/or z6 may provide further flexibility to tune performances and/or characteristics of the antenna A2.

In the antenna A2, the terminals gi5 and gi6 (isolation grounding terminals) may be responsible for connecting the ground plane G5. For example, the terminal gi5 may directly connect the ground plane G5 without interposed impedance between the terminal gi5 and the ground plane G5. Similarly, the terminal gi6 may directly connect the ground plane G5 without interposed impedance between the terminal gi6 and the ground plane G5.

In the antenna A2, the conductive section sa6 (the head section) may extend from the terminals d6 to hg6 along the loop 2202; the conductive section sb6 (intermediate section) may extend from the terminals hg6 to g6 along the loop 2202. The section si5 (isolation section) may extend from the terminals d6 to gi5 along the loop 2202, the section si6 (another isolation section) may extend from the terminals g6 to gi6 along the loop 2202. The section si7 may extend between the terminals gi3 and gi5, and the section si8 may extend between the terminals gi4 and gi6.

As shown in FIG. 25*a*, during the third operation mode, the sections sa6 and sb6 may jointly provide a conductive path 2510 between the terminal d6 and grounded terminal g6 to support a fourth electromagnetic resonance. As shown in FIG. 25*b* and FIG. 25*c*, during the fourth operation mode, the section sb6 may individually be a conductive path 2520 (FIG. 25*b*) to support a fifth electromagnetic resonance, and the section sa6 may alone be another conductive path 2530 (FIG. 25*c*) to support a sixth electromagnetic resonance. The fourth electromagnetic resonance may be a half-wave electromagnetic resonance with two anti-nodes at the terminals d6 and g6, as well as a single null approximately at middle point of the path 2510. The fifth electromagnetic resonance may be a half-wave electromagnetic resonance with two anti-nodes at the terminals hg6 and g6, as well as a single null approximately at middle point of the path 2520. The sixth electromagnetic resonance may be a half-wave electromagnetic resonance with two anti-nodes at the terminals hg6 and d6, as well as a single null at middle point of the path 2530. In an implementation, length of the section sb6 (path 2520) may be longer than a sum of length of the section si5 and length of the section sa6 (path 2530), so as to suppress undesired electromagnetic resonance of the section si5.

In an implementation, the antenna A1 and A2 may be utilized to facilitate antenna diversity. By arranging locations of the terminals of the antenna A1 and/or A2, length of the section sa5 and length of the section sa6 may be slightly different; and/or, length of the section sb5 and length of the section sb6 may be slightly different. Accordingly, performances and/or characteristics of the antennas A1 and A2 may also be slightly different, so as to provide diversity. For diversity, the signal Sf5 and Sf6 may be different.

In an implementation, when the antenna A1 works in the first operation mode (FIG. 24*a*), the antenna A2 may work in the third operation mode (FIG. 25*a*); and/or, when the antenna A1 works in the second operation mode (FIG. 24*b* and FIG. 24*c*), the antenna A2 may work in the fourth operation mode (FIG. 25*b* and FIG. 25*c*). In an implementation, the antennas A1 and A2 may switch operation mode independent of operation mode of each other.

FIG. 26 includes two plots 2620 and 2630. The plot 2620 includes curves 26A1 and 26A2; the curve 26A1 may indicate frequency dependency of return loss of the antenna A1 during the first operation mode (FIG. 24*a*), and the curve 26A2 may indicate frequency dependency of return loss of the antenna A2 during the third operation mode (FIG. 25*a*). The plot 2630 includes curves 27A1 and 27A2; the curve 27A1 may indicate frequency dependency of return loss of the antenna A1 during the second operation mode (FIG. 24*b* and FIG. 24*c*), and the curve 27A2 may indicate frequency dependency of return loss of the antenna A2 during the fourth operation mode (FIG. 25*b* and FIG. 25*c*).

As demonstrated by the plots 2620 and 2630, each of the antennas A1 and A2 may be a multi-band antenna. By controlling lengths of the sections of the antennas A1 and A2, performances and/or characteristics of the antennas A1 and A2, such as frequency domain locations of notches of return loss, may be made different, so as to provide diversity. The terminals gi3, gi4, gi5 and gi6 (FIG. 22, FIG. 23), which may be directly grounded to the ground plane G5, may provide isolation to suppress undesired mutual coupling of the antennas A1 and A2, even though the antennas A1 and A2 are implemented along the same closed loop 2202.

In an alternative implementation, one or both of the antennas A1 and A2 may be formed according to the antenna structure 1400 shown in FIG. 14. For example, besides the terminal hg5, the antenna A1 may also include one or more additional intermediate grounding terminals (not shown) controllable to be grounded (via impedance) or open-circuited; the additional interposed terminal(s) may locate between the terminals d5 and hg5, and/or between the terminals hg5 and g5. Accordingly, the antenna A1 may support more bands, similar to FIG. 17.

Figure 27:
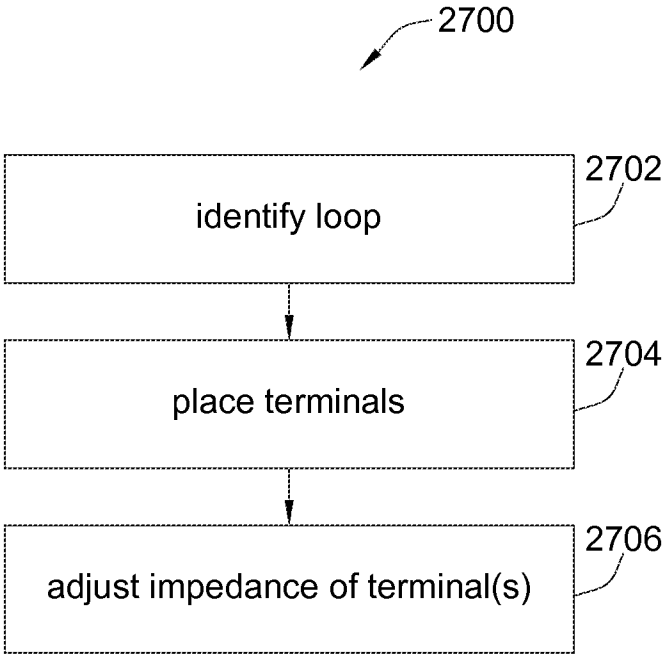
FIG. 27 illustrates a procedure according to an implementation of the disclosure.

Please refer to FIG. 27 illustrating a procedure 2700 for implementing an antenna structure along a loop. The procedure 2700 may include steps 2702, 2704 and 2706, which may be described as follows.

Step 2702: identify the loop for implementing the antenna structure, e.g., identify dimensions (width and/or length, etc) of the loop; also, identify (dimensions of) a ground plane. The loop may be a closed conductive loop, and may be a periphery of a metallic case of an electronic product.

Step 2704: according to demands of antenna design, such as band location(s) in frequency domain and bandwidth(s), place a feed terminal (e.g., d1 or d3 in FIG. 2 or 15) and a tail grounding terminal (e.g., g1 or g3 in FIG. 2 or 15) along the loop; also, place a number (one or more) of intermediate grounding terminals (e.g., hg1 in FIG. 2 or hg31 and hg32 in FIG. 15) along the loop between the feed terminal and the tail grounding terminal. The feed terminal may be responsible for connecting a feed signal, and the tail grounding terminal may be responsible for connecting the ground plane via a tail impedance. Each intermediate grounding terminal may selectively conducting and ceasing conducting to the ground plane via an associated intermediate impedance during two different operation modes. Accordingly, a conductive path (e.g., 510 or 1610 in FIG. 5*a* or 16*a*) extending from the feed terminal, the number of intermediate grounding terminals to the tail grounding terminal along the loop may support a first electromagnetic resonance when each intermediate grounding terminal ceases conducting to the ground plane via the associated intermediate impedance. On the other hand, when a selected one of the number of intermediate grounding terminals conducts to the ground plane via the associated intermediate impedance, a portion of the conductive path (e.g., 520 or 530 in FIG. 5*b* or 5*c*; 1620 or 1630 in FIG. 16*b*, 1640 or 1650 in FIG. 16*c*), extending from the selected intermediate grounding terminal to the feed terminal or the tail grounding terminal, may be reused to support one or more additional electromagnetic resonances. The first electromagnetic resonance and the additional electromagnetic resonance may be different, e.g., in wavelength and location(s) of null and anti-node.

Step 2706: if necessary, adjust the intermediate impedance(s) and/or the tail impedance to tune performances and/or characteristics of the antenna structure.

To implement multiple antennas in the same loop, steps 2704 and 2706 may be repeated along with insertion of one or more isolation terminals between the antennas for (directly) connecting the ground plane.

To sum up, the antenna structure according to the disclosure may be easily implemented by conductive and closed peripheral loop of metallic case, and may not need dielectric gaps to break the loop to an unclosed one. Between a feed terminal and a grounded terminal, by placing one or more intermediate grounding terminals controllable to be grounded or open-circuited in different operation modes, a portion of the loop which extends between the feed terminal and the grounded terminal may be electromagnetically divided in different ways, so the same portion may be reused to provide different bands during the different operation modes. Design of the antenna structure may be broadly applied to different sized loops to satisfy variety of product design, and provide sufficient flexibility to tune antenna performances and/or characteristics to satisfy demands and compliance of antenna design. For example, location(s) of terminal(s) and impedance(s) connected to terminal(s) may be adjusted to tune antenna performances and/or characteristics. As demonstrated by the implementation shown in FIG. 22, the antenna structure may include multiple antennas, and each antenna may be a multi-band antenna.

While the disclosure has been described in terms of what is presently considered to be the most practical implementations, it is to be understood that the disclosure needs not be limited to the disclosed implementation. On the contrary, it is intended to cover various modifications and similar arrangements included within the spirit and scope of the appended claims which are to be accorded with the broadest interpretation so as to encompass all such modifications and similar structures.

What is claimed is:

1. An antenna structure comprising:

a feed terminal for connecting a feed signal;

an intermediate grounding terminal for:

conducting to a ground plane via an intermediate impedance during a second operation mode, and ceasing conducting via the intermediate impedance during a first operation mode;

a tail grounding terminal for connecting the ground plane;

a head section, being conductive, extending from the feed terminal to the intermediate grounding terminal along a loop; and an intermediate section, conductively extending from the intermediate grounding terminal to the tail grounding terminal along the loop, and conductively connecting the head section.

2. The antenna structure of claim 1 further comprising:

a tail section, being conductive, extending from the tail grounding terminal to the feed terminal along the loop, without overlapping the head section.

3. The antenna structure of claim 2, wherein a length of the intermediate section is longer than a sum of a length of the tail section and a length of the head section.

4. The antenna structure of claim 2, wherein a length of the intermediate section is longer than a length of the head section, and longer than a length of the tail section.

5. The antenna structure of claim 1, wherein the tail grounding terminal is for connecting the ground plane via a tail impedance.

6. The antenna structure of claim 1 being capable of providing a first band during the first operation mode, and providing a second band during the second operation mode, wherein a frequency of the second band is higher than a frequency of the first band.

7. The antenna structure of claim 1 further comprising:

a second intermediate grounding terminal for:

conducting to the ground plane via a second intermediate impedance during a third operation mode, and ceasing conducting via the second intermediate impedance during the first operation mode;

wherein the head section comprises:

a first front section extending from the feed terminal to the second intermediate grounding terminal along the loop, and a second front section extending from the second intermediate grounding terminal to the intermediate grounding terminal along the loop, without overlapping the first front section.

8. The antenna structure of claim 7 being capable of providing a first band during the first operation mode, providing a second band during the second operation mode, and providing a third band and a fourth band during the third operation mode, wherein:

a frequency of the second band is higher than a frequency of the first band, a frequency of the third band is between the frequency of the first band and the frequency of the second band, and a frequency of the fourth band is higher than the frequency of the second band.

9. The antenna structure of claim 1 further comprising:

an isolation grounding terminal for connecting the ground plane;

an isolation section, being conductive, extending from one of the feed terminal and the tail grounding terminal to the isolation grounding terminal along the loop, without overlapping the head section and the intermediate section.

10. The antenna structure of claim 9 further comprising:

a second feed terminal for connecting a second feed signal; and an additional section extending from the isolation terminal to the second feed terminal, without overlapping the isolation section;

wherein the second feed signal is different from the feed signal.

11. An antenna structure comprising:

a feed terminal for connecting a feed signal;

an intermediate grounding terminal;

a tail grounding terminal for connecting a ground plane;

a head section, being conductive, extending from the feed terminal to the intermediate grounding terminal along a loop, for supporting a third electromagnetic resonance during a second operation mode; and an intermediate section, conductively extending from the intermediate grounding terminal to the tail grounding terminal along the loop without any in-between feed terminal, and conductively connecting the head section, for supporting a second electromagnetic resonance during the second operation mode, and supporting a first electromagnetic resonance jointly with the head section during a first operation mode.

12. The antenna structure of claim 11 further comprising:

a tail section, being conductive, extending from the tail grounding terminal to the feed terminal along the loop, without overlapping the head section;

wherein a length of the intermediate section and a length of the tail section are arranged to cause the second electromagnetic resonance to overpower an electromagnetic resonance supported by the tail section.

13. The antenna structure of claim 11, wherein the intermediate grounding terminal is for:

conducting to the ground plane via an intermediate impedance during the second operation mode, and ceasing conducting via the intermediate impedance during the first operation mode.

14. The antenna structure of claim 11, wherein the tail grounding terminal is for connecting the ground plane via a tail impedance.

15. The antenna structure of claim 11 being capable of providing a first band during the first operation mode, and providing a second band during the second operation mode, wherein a frequency of the second band is higher than a frequency of the first band.

16. The antenna structure of claim 11 further comprising:

a second intermediate grounding terminal;

wherein the head section comprises:

a first front section extending from the feed terminal to the second intermediate grounding terminal along the loop, and a second front section extending from the second intermediate grounding terminal to the intermediate grounding terminal along the loop, without overlapping the first front section;

wherein, during a third operation mode, the first front section further supports a fourth electromagnetic resonance, and the second front section and the intermediate section further of jointly support a fifth electromagnetic resonance.

17. The antenna structure of claim 16, wherein the second intermediate grounding terminal is for:

conducting to the ground plane via a second intermediate impedance during the third operation mode, and ceasing conducting via the intermediate impedance during the first operation mode.

18. The antenna structure of claim 16 being capable of providing a first band during the first operation mode, providing a second band during the second operation mode, and providing a third band and a fourth band during the third operation mode, wherein:

a frequency of the second band is higher than a frequency of the first band, a frequency of the third band is between the frequency of the first band and the frequency of the second band, and a frequency of the fourth band is higher than the frequency of the second band.

19. The antenna structure of claim 11 further comprising:

an isolation grounding terminal for connecting the ground plane;

an isolation section, being conductive, extending from one of the feed terminal and the tail grounding terminal to the isolation grounding terminal along the loop, without overlapping the head section and the intermediate section.

20. The antenna structure of claim 19 further comprising:

a second feed terminal for connecting a second feed signal; and an additional section extending from the isolation terminal to the second feed terminal along the loop, without overlapping the isolation section;

wherein the second feed signal is different from the feed signal.

21. The antenna structure of claim 11, wherein the third electromagnetic resonance is a half-wave resonance of a third wavelength, and the second electromagnetic resonance is a half-wave resonance of a second wavelength.

* * * * *